US008800309B2

(12) United States Patent
Buda et al.

(10) Patent No.: US 8,800,309 B2
(45) Date of Patent: Aug. 12, 2014

(54) METHOD OF AUTOMATICALLY DETECTING AN ANOMALOUS CONDITION RELATIVE TO A NOMINAL OPERATING CONDITION IN A VAPOR COMPRESSION SYSTEM

(75) Inventors: Paul Robert Buda, Raleigh, NC (US); Roy Stephen Colby, Raleigh, NC (US); Scott Robert Littler, Nashville, TN (US)

(73) Assignee: Schneider Electric USA, Inc., Palatine, IL (US)

( * ) Notice: Subject to any disclaimer, the term of this patent is extended or adjusted under 35 U.S.C. 154(b) by 1170 days.

(21) Appl. No.: 12/636,929

(22) Filed: Dec. 14, 2009

(65) Prior Publication Data

US 2011/0144807 A1 Jun. 16, 2011

(51) Int. Cl.
*F25B 49/00* (2006.01)
*G01K 13/00* (2006.01)

(52) U.S. Cl.
USPC ..... 62/126; 62/129; 62/176.3

(58) Field of Classification Search
USPC ..... 62/126, 129, 176.3, 214, 215, 226, 62/228.1, 228.5, 324.6
See application file for complete search history.

(56) References Cited

U.S. PATENT DOCUMENTS

| | | | | |
|---|---|---|---|---|
| 4,495,779 | A * | 1/1985 | Tanaka et al. | 62/211 |
| 5,224,354 | A * | 7/1993 | Ito et al. | 62/210 |
| 5,551,248 | A * | 9/1996 | Derosier | 62/155 |
| 5,867,998 | A * | 2/1999 | Guertin | 62/211 |
| 6,018,958 | A * | 2/2000 | Lingelbach et al. | 62/119 |
| 6,571,566 | B1 | 6/2003 | Temple et al. | |
| 6,631,617 | B1 * | 10/2003 | Dreiman et al. | 62/84 |
| 6,708,508 | B2 * | 3/2004 | Demuth et al. | 62/129 |
| 7,146,819 | B2 * | 12/2006 | Demuth et al. | 62/129 |
| 7,600,390 | B2 * | 10/2009 | Manole | 62/510 |
| 8,205,427 | B2 * | 6/2012 | Schwarz et al. | 60/39.08 |
| 2004/0159113 | A1 | 8/2004 | Singh et al. | |
| 2005/0235660 | A1 | 10/2005 | Pham | |
| 2007/0163276 | A1 | 7/2007 | Braun et al. | |

(Continued)

FOREIGN PATENT DOCUMENTS

WO 2009/038624 A1 3/2009

OTHER PUBLICATIONS

Written Opinion corresponding to International Patent Application No. PCT/US2010/059413, European Patent Office, dated Apr. 11, 2011, 5 pages.

(Continued)

*Primary Examiner* — Ljiljana Ciric
(74) *Attorney, Agent, or Firm* — Locke Lord LLP

(57) ABSTRACT

A method of automatically detecting an anomalous condition relative to a nominal operating condition in a vapor compression system. An expected input power function in the form of a hyperplane is calculated based on three temperature readings: an intake temperature from an intake area of the condenser unit, a return temperature from an intake area of an evaporator unit, and a supply temperature from a supply output area of the evaporator unit. The function produces an estimate of the expected input power consumed by the compressor unit, and this expected input power is compared with an actual input power measured from the compressor unit. If the expected input power deviates from the measured input power by more than a predetermined tolerance, an indication is stored and communicated that an anomalous condition, such as a refrigerant loss, condenser unit fouling, or a malfunctioning fan, exists in the vapor compression system.

29 Claims, 22 Drawing Sheets

(56) References Cited

U.S. PATENT DOCUMENTS

| | | | | |
|---|---|---|---|---|
| 2014/0000291 | A1* | 1/2014 | Kates | 62/56 |
| 2014/0000292 | A1* | 1/2014 | Kates | 62/56 |
| 2014/0000293 | A1* | 1/2014 | Kates | 62/56 |

OTHER PUBLICATIONS

International Search Report corresponding to International Patent Application No. PCT/US2010/059413, European Patent Office, dated Apr. 11, 2011, 4 pages.

Performance of a Residential Heat Pump Operating in the Cooling Mode with Single Faults Imposed, Applied Thermal Engineering 29(2009) 770-778, M. Kim, W. V. Payne, P. A. Domanski, S. Ho Yoon, C. J. L. Hermes, (Apr. 4, 2008) (9 pages).

Development of Refrigerant Charge Indicator and Dirty Air Filter Sensor, ORNL/CON-489, V.C. Mei, F.C. Chen, Z. Gao, Feb. 2003 (29 pages).

Virtual Refrigerant Pressure Sensors for Use in Monitoring and Fault Diagnosis of Vapor-Compression Equipment, vol. 15, No. 3., HVAC&R Research, H. Li, J. Braun, May 2009 (20 pages).

A Statistical, Rule-Based Fault Detection and Diagnostic Method for Vapor Compression Air Conditioners, vol. 3, No. 1, HVAC&R Research, T. Rossi, J. Braun, Jan. 1997 (19 pages).

Transient Characteristics of Split Air-Conditioning Systems Using R-22 and R-410A as Refrigerants, vol. 15, No. 3, HVAC&R Research, R. Kapadia, S. Jain, R. Agarwal, May 2009 (33 pages).

* cited by examiner

FIFO State Variable Flowchart

Slope Filtering Block Diagram

METHOD OF AUTOMATICALLY DETECTING AN ANOMALOUS CONDITION RELATIVE TO A NOMINAL OPERATING CONDITION IN A VAPOR COMPRESSION SYSTEM

FIELD OF THE INVENTION

The present disclosure relates generally to automated detection systems, and, more particularly, to a system and method for automatically detecting an anomalous condition relative to a nominal operating condition in a vapor compression system.

BACKGROUND

With increasing energy costs, there is a growing interest in energy monitoring. For instance, with the advent of demand-response pricing in which the price of electricity at the entry point to a building can fluctuate instantaneously, knowing the present power consumption and the allocation of power among the various devices and systems powered can be beneficial in optimizing energy cost.

Knowledge of whether the present rate of energy consumption is optimal or reasonable for the present conditions can also be beneficial. In some cases, whether these optimal conditions exist is relatively easy to determine. For example, when a room is totally unoccupied, it is reasonable to turn un-needed lights off. Similarly, in a home environment, leaving an electric oven "on" in the hot summer when no one is cooking is not normally a reasonable practice. By contrast, the optimal or appropriate operation of more complex appliances or equipment is less easy to determine.

As an example, undetected refrigerant loss in Vapor Compression Cycle (VCC) equipment, or a so-called heat pumping system that removes heat from one space and deposits in another, such as a residential or commercial heat pump, air conditioning or refrigeration system, can be a significant source of annoyance and cause of excessive and wasteful energy usage. Most refrigerant leakage losses are not fast enough to readily detect the degradation in performance of the unit over the course of a day or even a week. In cases in which VCC equipment is used strictly as an air conditioner, refrigerant loss can occur over the winter while the system is idle. When an air conditioning system is first turned on or activated in the spring, system usage is generally relatively low and a loss of efficiency due to refrigerant loss can go undetected, manifesting itself only when system usage increases on hotter days. In a residential split system that includes an outdoor compressor/condenser unit and an indoor evaporator/air handler unit, the compressor is located outside the residence, and the residents of a dwelling may not notice a problem until either an unexpectedly large bill is received from the utility or the capacity of the air conditioning system is degraded to the point where it cannot keep up with demand. In either case, frustration can result as many residences in a geographical region discover the problem simultaneously on a hot day, and it becomes challenging and time-consuming to dispatch technicians to diagnose and remedy this common problem. This problem extends to commercial systems as well. A method that can reliably and quickly detect and report abnormalities such as a loss of refrigerant would be highly desirable.

With the recent advent of higher energy prices, there is becoming increased interest in power and energy monitoring. Applied to an HVAC system, it is not sufficient to know merely how much energy is consumed, although this is useful information. More importantly, it would be useful to be able to predict whether the HVAC system is operating normally for the ambient conditions encountered, including the outdoor temperature and the conditions in the space for which temperature control is provided.

The expected normal operation of an HVAC system is not always intuitively apparent. First, there can be unit-to-unit manufacturing variations, including normal manufacturing tolerances, causing variation in compressor isentropic efficiency, condenser and evaporator efficiency, and other aspects. More importantly, no two systems are installed in precisely the same manner, resulting in different air flows across the condenser and evaporator coils from unit to unit, different lengths of refrigerant lines in split-system applications, and varying efficiency of refrigerant line insulation. Additionally, the system is highly sensitive to the level to which it is charged with refrigerant, and there is significant variance from unit to unit and from charging to charging that makes it very difficult to determine a-priori the power consumption of a system.

It would be desirable to provide a system and method that can automatically learn to predict the expected behavior of VCC-based equipment, and subsequently detect and report such conditions as refrigerant loss in a timely manner, without needing to disturb the vapor compression equipment in any way. The present disclosure is directed to such a system and method.

BRIEF SUMMARY

The present disclosure discloses systems and methods for continuously monitoring the compressor power and signals responsive to temperature for assessing and reporting the condition of a VCC-based air conditioner, heat pump or refrigeration system, or other heat pumping system. A Compressor Power Input Predictor (CIPP) relation between compressor power and certain signals responsive to temperature in the vicinity of the condenser and evaporator units can be learned by observing a properly charged air conditioner or heat pump over an interval of time, while the CIPP relation is established and validated.

The measured power can be continuously compared against the established CIPP relation, where a reduction in measured power compared with the predicted power is indicative of a loss of refrigerant. The indicated loss of refrigerant or condenser fouling can be communicated to another system so that early corrective maintenance of the condition can be carried out, minimizing discomfort to the building occupants while simultaneously reducing energy consumption. The correct refrigerant level can be quickly established or re-established in a system for which the appropriate refrigerant charge level has already been established initially, using the CIPP relation to indicate that the appropriate refrigerant charge level is established.

Various exemplary methods, which can also be implemented as systems or embodied in computer-readable medium, will be summarized next. These summaries are examples only, and are not intended to be an exhaustive recitation of the inventions disclosed herein.

According to an implementation of the aspects disclosed herein, a method of automatically detecting an anomalous condition relative to a nominal operating condition in a vapor compression system, includes: automatically calculating a measured input power function that includes a current measured from a compressor unit of the vapor compression system, which includes a condenser unit coupled to the compressor unit; receiving a condenser temperature indicative of an intake temperature from an intake of the condenser unit; automatically calculating an expected input power function that includes the condenser temperature; responsive to the expected input power function deviating from the measured input power function by more than a predetermined tolerance, storing an indication that an anomalous condition exists in the vapor compression system. The condenser temperature can be the intake temperature. The intake temperature can be received from a first temperature sensor positioned in the intake area of the condenser unit.

The method can further include receiving an interior temperature indicative of an indoor temperature of an indoor environment or a temperature of a closed managed thermal space within the indoor environment. The expected input power function can include the interior temperature. The interior temperature can be a thermostat setpoint temperature. The interior temperature can be an ambient temperature of an indoor environment on which the vapor compression system operates. Alternately, the interior temperature can be a return temperature from a temperature sensor positioned in an intake area of an evaporator unit in the vapor compression system. The expected input power function can include the return temperature. The interior temperature can be a supply temperature from a supply output area of an evaporator unit in the vapor compression system. The expected input power function can include the supply temperature.

The expected input power function can include a hyperplane, which includes a power offset constant, a first condenser temperature coefficient, and a second interior temperature coefficient. The power offset constant can be expressed in the unit of the measured input power function. The first condenser temperature coefficient can represent temperature sensitivity relating to the condenser temperature. The second interior temperature coefficient can represent temperature sensitivity relating to the return temperature. The first condenser temperature coefficient can be multiplied by the condenser temperature in the hyperplane, and the second interior temperature coefficient can be multiplied by the return temperature in the hyperplane.

The method can further include receiving a supply temperature at a supply output of the evaporator unit. The expected input power function can further include the supply temperature. The hyperplane can further include a third interior temperature coefficient representing temperature sensitivity to the supply temperature. The third interior temperature coefficient can be multiplied by the supply temperature in the hyperplane.

The method can further include automatically deriving the power offset constant, the first condenser temperature coefficient, the second interior temperature coefficient, and the third interior temperature coefficient by a least-squares regression analysis. The expected input power function can be independent of any pressure measurement relating to the vapor compression system.

In response to the measured input power function being less than the expected input power function by more than the predetermined tolerance, the anomalous condition can indicate a loss of refrigerant in the vapor compression system. The method can further include automatically calculating the expected input power function as refrigerant is added to the vapor compression system and, responsive to the expected input power function being within the predetermined tolerance of the measured input power function, indicating that the vapor compression system has returned to the nominal operating condition.

In response to the expected input power function being less than the measured input power function by more than the predetermined tolerance, the anomalous condition can indicate a fouling of the condenser unit in the vapor compression system or a malfunctioning fan in the vapor compression system. In response to the measured input power function being less than the expected input power function by more than the predetermined tolerance, the anomalous condition can represent a loss of refrigerant in the vapor compression system. The method can further include automatically comparing the expected input power function with the measured input power function, in response to additional refrigerant being added to the vapor compression system, until the expected input power function falls within the predetermined tolerance of the measured input power function, and indicating to an operator that no additional refrigerant is required to be added.

The current can correspond to a line current to the compressor unit measured by a current transformer. The measured input power function can include a line voltage measured across a line conductor and a neutral conductor connected to the compressor unit. The automatically calculating the measured input power function can be carried out in a power monitor coupled to the current transformer.

The interior temperature can be a return temperature from an intake area of an evaporator unit. The receiving the condenser temperature and the return temperature can be carried out at a sample rate interval, where the method further includes: delaying the automatically calculating the expected input power function by a predetermined number of cycles of a sample rate at which samples of the condenser temperature and the return temperature are received; and storing each sample of the condenser temperature and the return temperature.

The vapor compression system can include an air conditioner system, a heat pump system, a chiller, or a refrigeration system. The vapor compression system can include a heat pump system, refrigerant for the heat pump system can be evaporated in the condenser unit, and high-pressure refrigerant vapor can be compressed in the evaporator unit.

The method can further include: automatically determining whether the compressor unit is in an ON state or an OFF state by comparing the measured input power function against a power threshold constant for a predetermined number of cycles as determined by a sampling rate of the current measurements; and responsive to the measured input power function exceeding the power threshold constant for the predetermined number of cycles, storing an indication that the compressor unit is in the ON state. The method can further include deriving the power threshold constant by multiplying a nominal system voltage of the vapor compression system by a rated full-load current drawn by the compressor unit to produce a rated power, and multiplying the rated power by a percentage threshold. The method can further include, responsive to the measured input power function not exceeding the power threshold constant for a second predetermined number of cycles, storing an indication that the compressor unit is in an OFF state.

The condenser temperature can be of a gas or a liquid. The interior temperature can be of a liquid or a gas. The current measured from the compressor unit can be an RMS current calculated from the measured current. The condenser temperature can be an outdoor temperature of an outdoor environment.

According to another implementation of aspects of the present disclosure, a method of automatically detecting an anomalous condition relative to a nominal operating condition in a vapor compression system, includes: automatically calculating a measured input power function that includes a current measured from a compressor unit of the vapor compression system, which includes a condenser unit coupled to the compressor unit; receiving a condenser temperature indicative of an intake temperature from an intake area of the condenser unit; receiving an interior temperature indicative of an indoor temperature of an indoor environment or a temperature of a closed managed thermal space within the indoor environment; automatically calculating an expected input power function that includes the condenser temperature and the interior temperature; responsive to the expected input power function deviating from the measured input power function by more than a predetermined tolerance, storing an indication that an anomalous condition exists in the vapor compression system.

The interior temperature can be a return temperature from an intake area of an evaporator unit in the vapor compression system. The expected input power function can include a hyperplane. The hyperplane can include a power offset constant, a first condenser temperature coefficient, and a second interior temperature coefficient. The power offset constant can be expressed in the unit of the measured input power function. The first condenser temperature coefficient can represent temperature sensitivity relating to the condenser temperature. The second interior temperature coefficient can represent temperature sensitivity relating to the return temperature. The first condenser temperature coefficient can be multiplied by the condenser temperature in the hyperplane. The second interior temperature coefficient can be multiplied by the return temperature in the hyperplane.

The method can further include receiving a supply temperature at a supply output area of an evaporator unit in the vapor compression system. The expected input power function can further include the supply temperature. The interior temperature can be a return temperature from an intake area of an evaporator unit. The expected input power function can include a hyperplane. The hyperplane can include a power offset constant, a first condenser temperature coefficient, a second interior temperature coefficient, and a third interior temperature coefficient representing temperature sensitivity to an average of the return temperature and the supply temperature. The power offset constant can be expressed in the unit of the measured input power function. The first condenser temperature coefficient can represent temperature sensitivity relating to the condenser temperature. The second interior temperature coefficient can represent temperature sensitivity to the return temperature. The third interior temperature coefficient can represent temperature sensitivity to the supply temperature. The first condenser temperature coefficient can be multiplied by the condenser temperature in the hyperplane. The second interior temperature coefficient can be multiplied by the return temperature in the hyperplane. The third interior temperature coefficient can be multiplied by the supply temperature in the hyperplane.

In response to the measured input power function being less than the expected input power function by more than the predetermined tolerance, the anomalous condition can indicate a loss of refrigerant in the vapor compression system. In response to the expected input power function being less than the measured input power function by more than the predetermined tolerance, the anomalous condition can indicate a fouling of the condenser unit in the vapor compression system or a malfunctioning fan in the vapor compression system.

The method can further include: automatically determining whether the compressor unit is in an ON state or an OFF state by comparing the measured input power function against a power threshold constant for a predetermined number of cycles as determined by a sampling rate of the current measurements; responsive to the measured input power function exceeding the power threshold constant for the predetermined number of cycles, storing an indication that the compressor unit is in the ON state; deriving the power threshold constant by multiplying a nominal system voltage of the vapor compression system by a rated full-load current drawn by the compressor unit to produce a rated power, and multiplying the rated power by a percentage threshold; and responsive to the measured input power function not exceeding the power threshold constant for a second predetermined number of cycles, storing an indication that the compressor unit is in an OFF state.

According to yet another implementation of aspects of the present disclosure, a method of automatically detecting an anomalous condition relative to a nominal operating condition in a vapor compression system, includes: receiving input power measured from a compressor unit of the vapor compression system that includes a condenser unit coupled to the compressor unit; receiving a condenser temperature indicative of an intake temperature from an intake area of the condenser unit; receiving an interior temperature indicative of an indoor temperature of an indoor environment or a temperature of a closed managed thermal space within the indoor environment; receiving a supply temperature at a supply output area of the evaporator unit; automatically calculating an expected input power function that includes the condenser temperature, the interior temperature, and the supply temperature; responsive to the expected input power function deviating from the measured input power function by more than a predetermined tolerance, storing an indication that an anomalous condition exists in the vapor compression system.

The interior temperature can be a return temperature from an intake area of the evaporator unit. The expected input power function can include a hyperplane. The hyperplane can include a power offset constant, a first condenser temperature coefficient, a second interior temperature coefficient, and a third interior temperature coefficient representing temperature sensitivity to an average of the return temperature and the supply temperature. The power offset constant can be expressed in the unit of the measured input power function. The first condenser temperature coefficient can represent temperature sensitivity relating to the condenser temperature. The second interior temperature coefficient can represent temperature sensitivity to the return temperature. The third interior temperature coefficient can represent temperature sensitivity to the supply temperature. The first condenser temperature coefficient can be multiplied by the condenser temperature in the hyperplane. The second interior temperature coefficient can be multiplied by the return temperature in the hyperplane. The third interior temperature coefficient can be multiplied by the supply temperature in the hyperplane.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
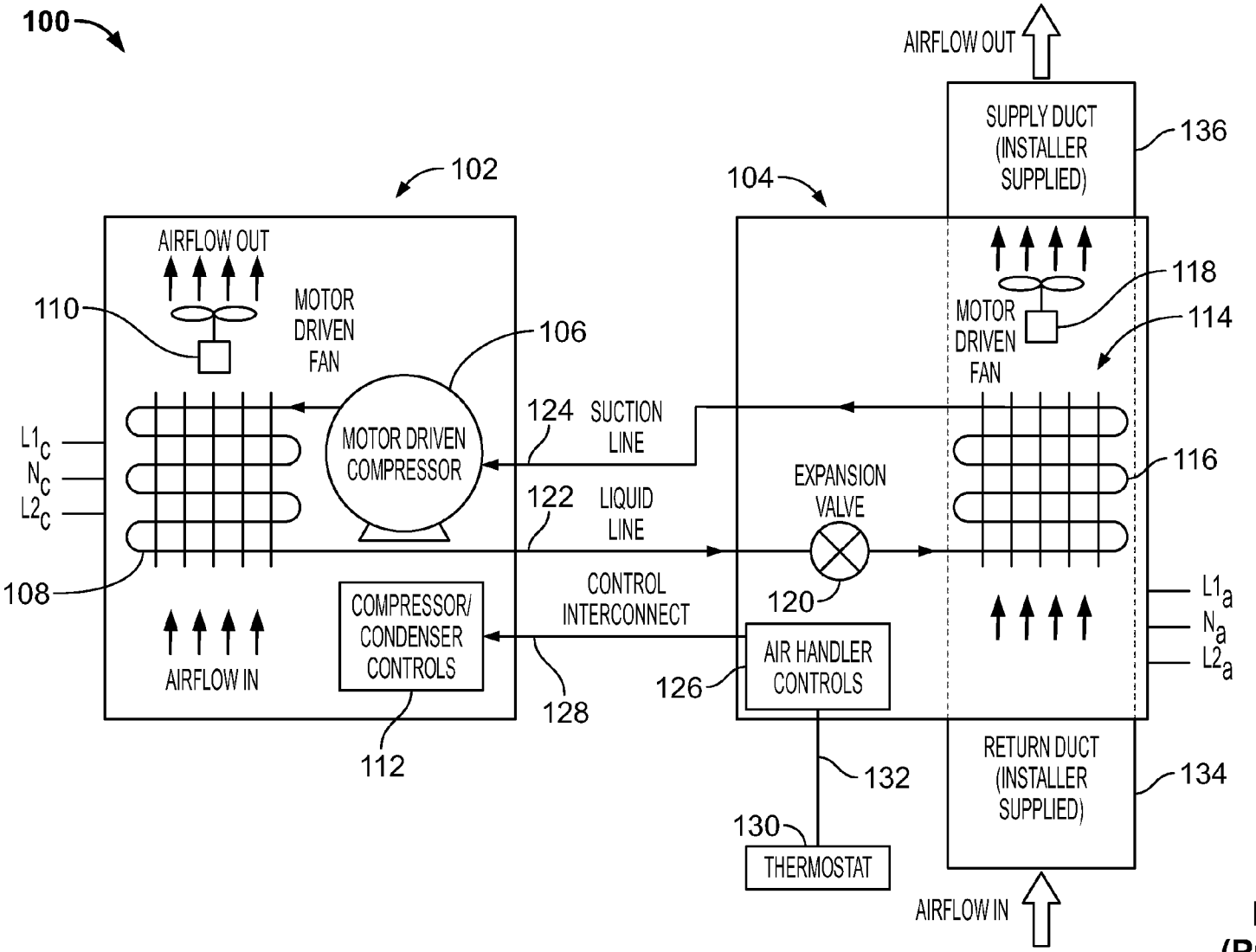
FIG. 1 (Prior Art)
FIG. 1 is a functional block diagram of a typical split system residential air conditioning unit, which includes two primary units in the form of a compressor/condenser unit and an air handler unit.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

1.1 Vapor Compression Cycle Equipment

The examples as described herein will utilize a monitor for a residential "split system" air conditioner, although it should be understood that the present disclosure is not limited to this type system. FIG. 1 is a block diagram of a typical split system residential air conditioning unit 100, comprising two major units in the form of a compressor/condenser unit 102 and an air handler unit 104. As used herein, the term "compressor/condenser unit" is understood to include at least two components, a compressor unit (e.g., a compressor 106) and a condenser unit (e.g., a condenser coil 108). The compressor/condenser unit 102 typically includes an electric motor-driven refrigerant compressor 106, a condenser coil 108, an electric motor-driven condenser fan 110 to draw or force air across the condenser coil 108, and compressor/condenser control circuitry 112 for controlling the motor of the compressor 106 and the motor of the condenser fan 110. Details of the control circuitry 112 vary from manufacturer to manufacturer and model to model, but typical compressor/condenser controls 112 include circuitry and hardware to remotely start and stop the condenser/compressor unit 102, as well as such equipment safety features as a motor current overload detection function and various electrical switches or controls that monitor refrigerant pressure and stop the condenser/compressor unit 102 automatically when the pressure becomes unacceptably high or unacceptably low.

In a split-system air conditioner, an air handler unit 104 is typically located remotely from the compressor/condenser unit 102. The air handler unit 104 includes an enclosed chamber 114, through which air to be cooled is drawn or forced across an evaporator coil 116 (evaporator unit) via a motor-driven fan 118. In normal operation, high pressure refrigerant is fluidically coupled from the output of the condenser coil 108 to an expansion valve 120 via a liquid line 122. The high-pressure, sub-cooled refrigerant in the liquid line 122 is forced through the expansion valve 120 and appears at the output of expansion valve 120 as a low pressure, atomized liquid, where it is coupled to the evaporator coil 116. The low pressure, atomized liquid refrigerant absorbs heat from the evaporator coil 116, where it quickly evaporates into a superheated vapor, cooling the air passing over the evaporator coil 116 in the process. The super-heated refrigerant is fluidically returned to the inlet of the motor-driven compressor 106 via a suction line 124.

The vapor compression cycle can be used to heat as well as to cool. For example, the split system described above can be adapted for heating rather than air conditioning in a configuration commonly known as a "heat pump." In the heat pump configuration a set of valves is typically employed to re-route the refrigerant flow such that the high pressure refrigerant vapor is condensed in coil 116, and the low pressure liquid refrigerant is evaporated in coil 108. Air is cooled as it flows across coil 108, and heated as it flows across coil 116. It is common in the HVAC industry for AC (air conditioning) systems to be configurable for either cooling or heating. It is also common in the HVAC industry to refer to coil 108 in such systems as the condenser coil (or simply condenser), and coil 116 in such systems as the evaporator coil (or simply evaporator), regardless of their function in the vapor compression cycle. Similarly, the compressor/condenser unit 102 in such systems is referred to as the compressor/condenser unit, and the unit 104 in such systems is referred to as the evaporator unit.

The installer of the split system air conditioner conventionally connects two air duct subsystems to air handler unit 104. A return duct 134, shown in FIG. 1 conducts warm air from the space to be cooled by the air conditioner. Once this air is cooled by the air conditioning unit, the cooled air is passed back to the conditioned space via a supply duct 136. The ductwork can be "customized" for a particular application. As such, the effect of ductwork on system operation is difficult to predict a-priori.

Because the air handler unit 104 in a split system is typically located remote from the compressor condenser unit 102, the two units can be fed via separate branch circuits in an electrical distribution system. The external compressor/condenser power supply in a residential VCC-based air conditioner or heat pump is typically a 3-wire, single phase, mid-point neutral 220 Volt system, and is identified by the three input wires L1*c*, L2*c* and Nc. Similarly, the air handler unit 104 is often also supplied by a 3-wire, single phase, mid-point neutral 220 Volt power system, and its supply is designated by the inputs L1*a*, L2*a* and Na, where L1 and L2 refer to lines 1 and 2, and N refers to neutral.

The compressor/condenser unit 102 and the air handler unit 104 are generally built by a manufacturer as individual units, not intended to be modified.

A typical residential VCC-based heat pumping system, such as an air conditioner or common heat pump, operates under the well understood principle of "bang-bang" control. Referring to FIG. 1, the thermostat device 130 typically includes two functions that directly control the air conditioning system 100. First, the thermostat device 130 communicates a signal to the air conditioning system 100, requesting the operation of the heat pump system under certain conditions. One such means of communication includes a thermally responsive contact closure that closes when the temperature rises above a first setpoint value, and subsequently opens when the temperature drops below a second value, normally based on the first. The air handler control 126 includes circuits responsive to the thermostatic contact closure and which can cause the air conditioning system 100 to turn on and off according to a pre-determined cycle of events. Second, the thermostat device 130 can include a three-position fan switch used to dictate operation of the motor-driven air handler fan 118. In a first position, the interaction between the fan switch and the air handler control circuitry 126 causes the air handler fan 118 to run continuously, independent of the state of the thermostatic switch. In a second position, the interaction between the fan switch and the air handler control circuitry 126 disables the fan operation as well as the compressor/condenser unit 102. In a third position, the fan switch interacts with the air handler control circuitry 126 to cause the air handler fan 118 to operate "automatically" in response to the thermostatic switch.

In a typical residential system, the user of the system generally sets only one temperature value (e.g., a thermostat setpoint temperature) on the thermostat device 130, denoted $T_{SP}$, with upper and lower operating temperatures $T_U$ and $T_L$ derived from this single value according to a rule that can be established mechanically or electronically. An example of such a rule can be to turn the air conditioning system 100 on when the sensed temperature of the ambient in the vicinity of the thermostat 130 rises 1° F. above the thermostat setpoint temperature, $T_{SP}$, set by the user and turn the air conditioning system 100 off when the sensed temperature in the vicinity of the thermostat 130 drops 1° F. below $T_{SP}$. In this manner, the air conditioning system 100 can regulate the temperature to within approximately +/−1° F. of the thermostat setpoint temperature value set by the user.

Figure 2:
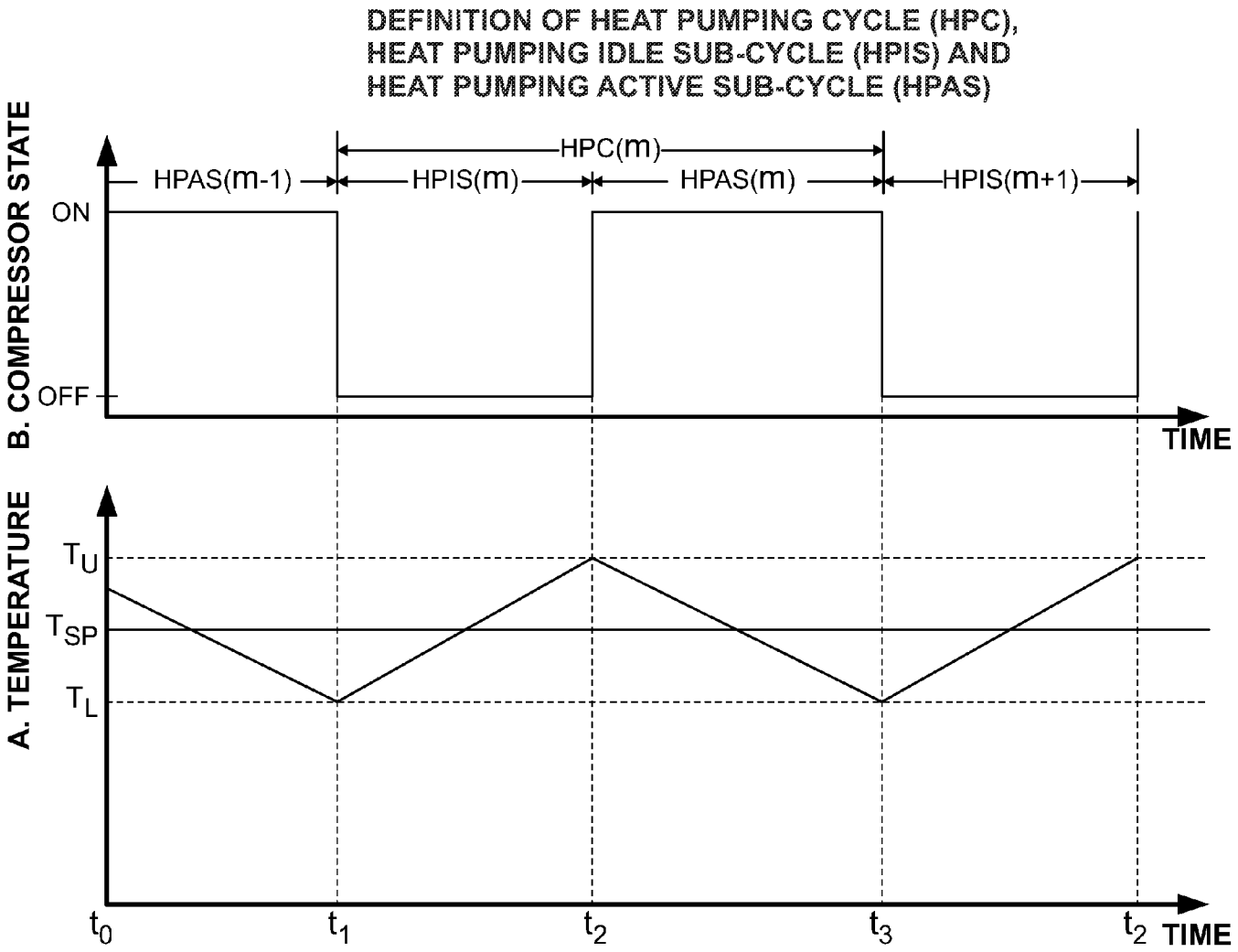
FIG. 2 (Prior Art)
FIG. 2 illustrates a typical timing for an air conditioning system, such as the air conditioning system shown in FIG. 1, operating under bang-bang cooling control.

FIG. 2 shows typical timing for a heat pumping system, in this case an air conditioning system such as the air conditioning system 100, operating under bang-bang cooling control. In FIG. 2, the horizontal ordinate axis is time, denoted by a lower-case t in what follows. The lower timing diagram shows temperature as a function of time, with temperature values denoted as upper-case T, and the upper diagram shows the corresponding state of the air conditioning system (ON or OFF) at a given time. The nominal thermostat setpoint temperature is denoted $T_{SP}$ in the lower timing diagram. The upper and lower temperatures, $T_U$ and $T_L$ described above are based on the thermostat setpoint temperature $T_{SP}$. For purposes of the present discussion of bang-bang control, assume that with regard to a closed space for which temperature is to be regulated, the so-called managed thermal space, heat sources internal to the managed thermal space and heat transfer into the managed thermal space from outside, will cause the temperature in the managed thermal space to rise at least to a value above the present upper setpoint, $T_U$ in the absence of air conditioning system operation.

Starting at time $t_0$, with the air conditioning system in the ON state, and the managed thermal space temperature at a value greater than $T_L$ as shown in the lower timing diagram of FIG. 2, the temperature drops due to the action of the air conditioning system until it reaches $T_L$ at time $t_1$, at which time the air conditioning system turns OFF in accordance with the bang-bang control described above. This transition at which the air conditioning system turns OFF marks the beginning of the $m^{th}$ heat pumping cycle, labeled HPC(m), with the index m indicating the $m^{th}$ time this has occurred since a reference time. Once the air conditioning system has turned OFF, heat is no longer being removed from the managed thermal space and, due to the assumption above, the temperature rises over time until it reaches $T_U$ at time $t_2$ as shown. When the temperature reaches $T_U$, the thermostat causes the air conditioning system to turn ON as indicated in the upper diagram of FIG. 2. With the air conditioning system operating, and assuming the air conditioning system is capable of removing heat at a faster rate than heat is transferred into the managed thermal space, the temperature of the managed thermal space begins again to fall. This drop in temperature continues until it reaches the lower set-point, $T_L$, shown occurring at time $t_3$, at which time the thermostat causes the air conditioning system to shut off. Once the air conditioning system shuts off, the temperature in the managed thermal space begins to rise again as shown in FIG. 2 and the process repeats.

As described below, the thermostat setpoint temperature can be used to calculate an expected input power consumed by the compressor/condenser unit 102 as described in more detail below in conjunction with an outdoor temperature, such as an intake temperature from an intake area of the compressor/condenser unit 102.

Within the interval comprising the $m^{th}$ cooling cycle, two sub-cycles are defined. The interval from $t_1$ to $t_2$, over which the air conditioner is OFF is referred to as the $m^{th}$ heat pumping idle sub-cycle, or HPIS(m) as indicated. The interval within the $m^{th}$ cooling cycle over which the air conditioner is ON (the interval between $t_2$ and $t_3$ in FIG. 2) is referred to as the heat pumping active sub-cycle, or HPAS(m). To be complete, note also that part of the heat pumping active subcycle of the previous HPC, labeled HPAS(m−1) is also shown, as is the complete HPIS of the next heat pumping cycle, labeled HPIS(m+1). The operation of a heat pumping system used to heat rather than cool is similar to that described in FIG. 2 with alternating intervals when the heat pumping system is ON and OFF. In general, the term heat pumping active sub-cycle, or HPAS, refers to the interval when the compressor unit of the heat pumping system is consuming power. Similarly, the term HPIS refers to the interval when the compressor unit of the heat pumping system is not consuming power.

Figure 3:
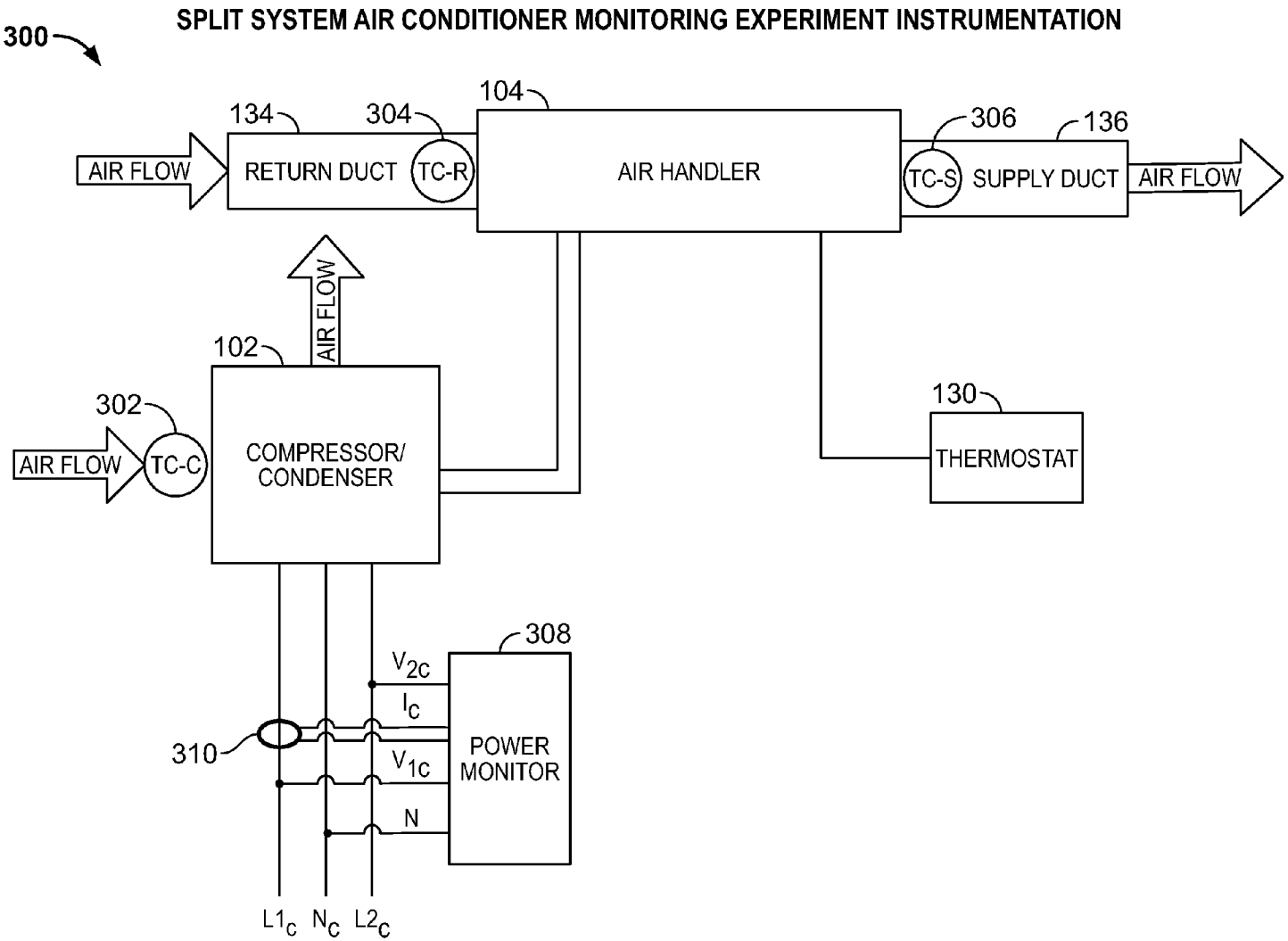
FIG. 3 illustrates an exemplary placement of three temperature sensors in an exemplary split-system having the compressor/condenser unit, air handler unit, return duct, supply duct, and thermostat shown in FIG. 1.

Having described the basic components and operation of a typical air conditioning system 100, attention is now turned to an experimentally determined relation between compressor input power and air temperatures in the vicinity of the compressor/condenser unit 102 (FIG. 1), supply duct temperature, and return duct temperature. FIG. 3 illustrates the placement of three temperature sensors in an exemplary split-system 300 having the compressor/condenser unit 102, air handler unit 104, return duct 134, supply duct 136, and thermostat 130 shown in FIG. 1. Three temperature sensors 302, 304, 306 are shown. One temperature sensor or thermocouple device 302, labeled TC-C, is placed in an intake area of the compressor/condenser unit 102 outside the managed thermal space of a building or in a laboratory environment, for example. Another temperature sensor or thermocouple device 304, TC-R, is mounted in the return air duct 134 in such a manner that the tip of the thermocouple is approximately centered in the cross-section of the duct (thus positioned in an intake area of the air handler unit 104, or, more specifically, in an intake area of the evaporator unit, such as the evaporator coil 116). The thermocouple device 304 TC-R is mounted near the air handler unit 104 at a distance sufficient to measure the temperature of the air entering the air handler unit 104. A purpose of the thermocouple device 304 TC-R is to estimate the air temperature on the return side of the evaporator unit. Similarly, a temperature sensor or thermocouple device 306, TC-S, is mounted in the supply duct 136, as near the air handler unit 104, and approximately centered in the cross-section of the supply duct 136 (thus positioned near the supply output area of the air handler unit 104).

The example refers to type J thermocouples as the temperature sensors, but other temperature measuring methods such as temperature dependent resistive devices, commonly called thermistors or RTD devices can alternately be employed, and there are also fully integrated temperature measuring devices in the form of integrated circuits that can be employed.

FIG. 3 shows a power monitoring device 308 coupled to the line input of the compressor/condenser unit 102, the purpose of which is to automatically calculate, using a controller, a measured input power function that includes at least a current and optionally a voltage measured from the compressor unit by the power monitoring device 308. Examples of the measured input power function include real power, apparent power, and RMS current. In a typical residential installation in the United States, the compressor/condenser unit 102 is fed by a 3-wire, single phase, mid-point neutral power system. The neutral tap is labeled $N_c$ in FIG. 3, while the two line conductors delivering power to the compressor/condenser unit 102 are labeled $L1_c$ and $L2_c$ In the example shown, voltage inputs to the power monitor 308 are labeled $V_{1C}$ and $V_{2C}$ and N and are created via voltage taps on the power distribution lines $L1_c$, $L2_c$ and N. In a typical arrangement, the conductor $L1_c$ passes through a commercially available toroidal-type current transformer 310. The outputs of the current transformer 310 are conventionally connected via wires to the power monitoring device 308, shown generally as the signal $I_C$, which corresponds to current signals $I_{C1}$ and $I_{C2}$, respectively. Having these signals available, the power monitoring device 308 can continuously compute the real power, reactive power, RMS voltage and RMS current and the resulting Volt-Ampere product of the power delivered to the compressor/condenser unit 102. A commercially available power monitoring device 308, such as a POWERLOGIC® PM850 power meter, manufactured by Schneider Electric, or any other suitable power monitoring device, can be employed to measure a power function such as real power or apparent power (the product of RMS Volts and RMS Amperes) consumed by the compressor/condenser unit 102.

The electrical components in the compressor/condenser unit 102 conventionally include a compressor that drives the vapor compression cycle and a fan, which causes air to pass over the condenser coil. The power consumed by the fan can be assumed to be nearly constant in a normally operating system.

Figure 4:
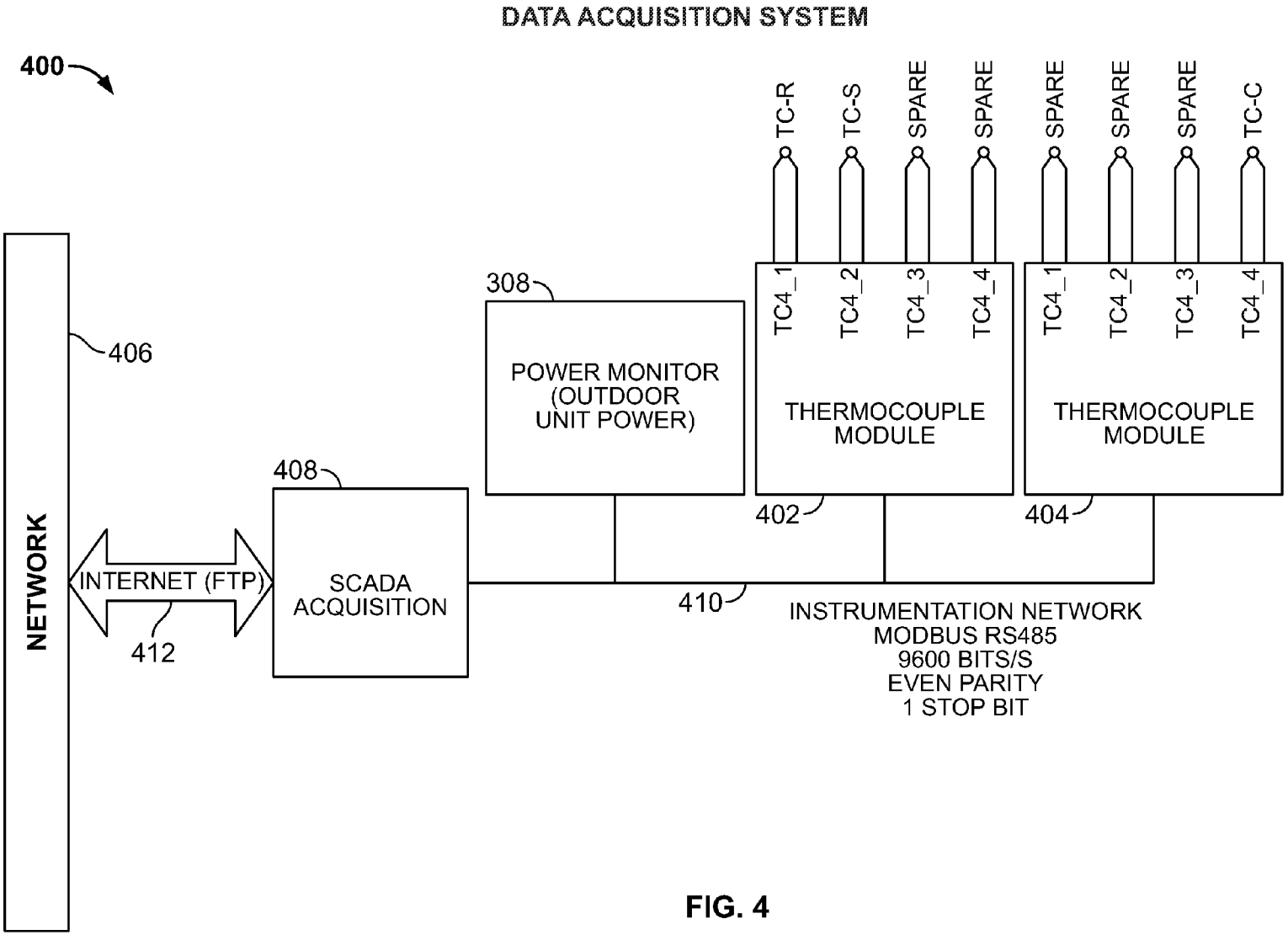
FIG. 4 illustrates a functional block diagram of a suitable data acquisition system configured to gather data from a monitored air conditioning system, such as the system shown in FIG. 3 or 11.

FIG. 4 illustrates a functional block diagram of an exemplary data acquisition system 400 configured to gather data from a monitored air conditioning system 300. The thermocouples 302, 304, 306 referenced above are electrically connected to two thermocouple modules 402, 404, such as an mV/Thermocouple Module, type DI-924MB, manufactured by DataQ. These thermocouple modules 402, 404 provide support for up to four thermocouples each, including an electronic cold junction reference for the thermocouples, and internal analog signal processing and analog to digital conversion and scaling of the sensed thermocouple voltage, resulting in an integer number equivalent to the temperature in degrees C. multiplied by 10. The thermocouple modules can communicate these temperature values to other equipment such as a slave device on a MODBUS network 410, an industry standard serial-communication network. Two thermocouple modules 402, 404 can be employed in the air conditioner monitoring system 300 because the air handler unit 104 and the condenser/compressor unit 102 are generally located a distance apart and temperature measurements are needed near each in some aspects of the present disclosure. As shown in FIG. 4, Thermocouples TC-R and TC-S are connected to Thermocouple Module 402 so it can be located near Air Handler unit 104, while Thermocouple TC-C is coupled to Thermocouple Module 404 so it can be located near the compressor/condenser unit 102, keeping the wiring between the thermocouples and their respective modules short to minimize electrical interference with the temperature measurements. An industrial communication network is preferable to a long length of thermocouple wire when clean measurements are desired.

The power monitoring device 308 can also provide MODBUS connection capability, and can be connected as a separate MODBUS slave device in the air conditioning monitoring network 410.

Central to the air conditioning monitoring (MODBUS) network 410 employed in gathering experimental data is a Supervisory Control and Data Acquisition (SCADA) system, such as the SCADA system 408, FACTORYCAST HMI™, manufactured by Schneider Electric. The SCADA system 408 is communicatively coupled to the power monitoring device 308 and to the thermocouple modules 402, 404 as the master device of the MODBUS network 410.

The SCADA system 408 receives and stores in a conventional electronic memory device digitized samples of the temperatures and power-related parameters described above at a rate of 0.5 Hz in the exemplary system and assembles the data collected into records of data. Each record of data represents the data obtained at a particular sample time from an air conditioning system, and the SCADA system 408 generates a time stamp using an internal time base that is also attached to the record. On an hourly basis or other time interval period, the data records can be retrieved from the SCADA system 408 via the Internet 412 using a standard FTP protocol by an external computer (not shown). The records can be stored as files on an electronic memory device on a network 406 for use in in manners to be discussed later.

In a nominally operating VCC-based heat pumping system, the relation between compressor inlet power and the measured temperatures is well described by a hyperplane. Let the variable $T_c$ be the compressor inlet air temperature as inferred by the thermocouple device 302 TC-C, $T_r$ the return inlet air temperature inferred by the thermocouple device 304 TC-R, and $T_s$ the supply duct air temperature inferred by the thermocouple device 306 TC-S, all temperature values assumed herein to be expressed in degrees Celsius. With these defined the hyperplane relation discovered is of the form:

$$P_e(T_c,T_r,T_s)=P_{c0}+k_cT_c+k_rT_r+k_sT_s \quad (1)$$

where,

- $P_e$ is the expected, or predicted compressor input power expressed in the unit of the measured input power function, which, in this example, is Watts, but can alternately be Amps when the measured input power function includes current measurements from the compressor unit and not voltage measurements;
- $P_{c0}$ is a power offset constant, expressed in the unit of the measured input power function, which, in this example, is Watts, but can alternately be Amps when the measured input power function includes current measurements from the compressor unit and not voltage measurements;
- $k_c$ is the temperature sensitivity in Watts (or Amps)/° C. to the input $T_c$;
- $k_r$ is the temperature sensitivity in Watts (or Amps)/° C. to the return temperature $T_r$; and
- $k_s$ is the temperature sensitivity in Watts (or Amps)/° C. to the supply temperature $T_s$.

The relation above (Equation 1) is herein referred herein to as the CIPP relation, an acronym meaning Compressor Input Power Predictor relation, or the expected input power function according to an aspect of the present disclosure. The expected input power function is compared with the measured input power function to determine how closely the measured quantity (e.g., real or apparent power or RMS current) of the measured input power function tracks the corresponding expected quantity (e.g., real or apparent power or RMS current) of the expected input power function. The example refers to real power as this measured input power function, but apparent power, average power, and RMS current can alternately be used. It is also be noted that one can assume that line voltage is a constant, nominal value and can be multiplied by measured RMS current to derive an approximation to Volt-Amperes. Henceforth when the term CIPP is used, it will be understood that it refers to the relation described by Equation (1) and its purpose is to track the measured input power function under nominal conditions.

Although the CIPP relation described by Equation (1) above includes the intake temperature and the supply and return temperatures, the expected input power of the compressor can be calculated from an expected input power function that includes a temperature exterior to the managed thermal space only, such as an outdoor temperature. This exterior temperature can be an intake temperature from an intake area of a compressor/condenser unit 102. In the case of an air conditioning or heat pump system, the exterior temperature corresponds to a temperature indicative of outdoor environment. This means that the exterior temperature can be measured, for example, in an attic of a residence, even though the compressor unit is located on the ground outside the residence. A measure of the attic temperature can approximate the temperature of the outdoor environment. In the case of a refrigeration system, the exterior temperature corresponds to a temperature exterior to the closed managed thermal space (i.e., outside of a refrigerator).

The expected input power function can also be calculated based on one outside temperature measurement and one or more indoor or interior temperature values. The indoor or interior temperature can correspond to an assumed value based on a thermostat setpoint temperature or to an ambient temperature measurement of an indoor environment on which the vapor compression system operates, such as a return temperature measurement from an intake area of an air handler unit 104 or a supply temperature measurement from a supply output area of the air handler unit 104 or both. Stated generally, an interior temperature can be indicative of an indoor temperature of an indoor environment (such as inside a building) or a temperature of a closed managed thermal space within an indoor environment (such as inside a refrigerator unit). A closed managed thermal space is a closed system inside a room or indoor environment. The indoor environment itself in which the closed system is housed is not considered to be a closed managed thermal space. Indoor environment is thus the broader concept, encompassing an entire building or a room inside a building, whereas a closed managed thermal space refers to a closed system within an indoor environment, such as a refrigerator unit when the vapor compression system is a refrigeration system. The term indoor refers to any space considered to be indoor as ordinary people understand that term. The term interior can also refer to such spaces and, generally, to any closed space indoors, such as inside a closed managed thermal system.

In short, the expected input power function described herein can be calculated based on one outdoor temperature measurement only or in combination with one or more indoor or interior temperature values, measured or assumed. The expected input power function can be independent of any pressure measurement relating to the compressor/condenser unit 102 or the air handler unit 104. In other words, no pressure measurements are necessary, though not precluded, to estimate the power consumed by the compressor/condenser unit 102. The outdoor and interior temperatures can be of a gas or a liquid, and the expected input power functions disclosed herein can be used in any vapor compression system such as an air conditioner system, a heat pump system, a chiller, or a refrigeration system.

The examples provided below assume three measured temperature inputs into the hyperplane, but the present disclosure contemplates using a single outdoor temperature measurement or an outdoor or external ambient temperature measurement and one or more interior temperature values. External refers to an area or space external to the equipment comprising the vapor compression system. While external typically will refer to an outdoor environment, it can also refer to an indoor environment that is external to the managed thermal space. For example, in the case of a refrigeration system, the external ambient temperature can refer to any temperature outside of a refrigerator unit being monitored, and this temperature will typically correspond to an ambient indoor temperature of the space or room in which the refrigerator unit is installed. It should be understood that the condenser unit (e.g., condenser coil 108) is exterior to the managed thermal space.

Figure 5:
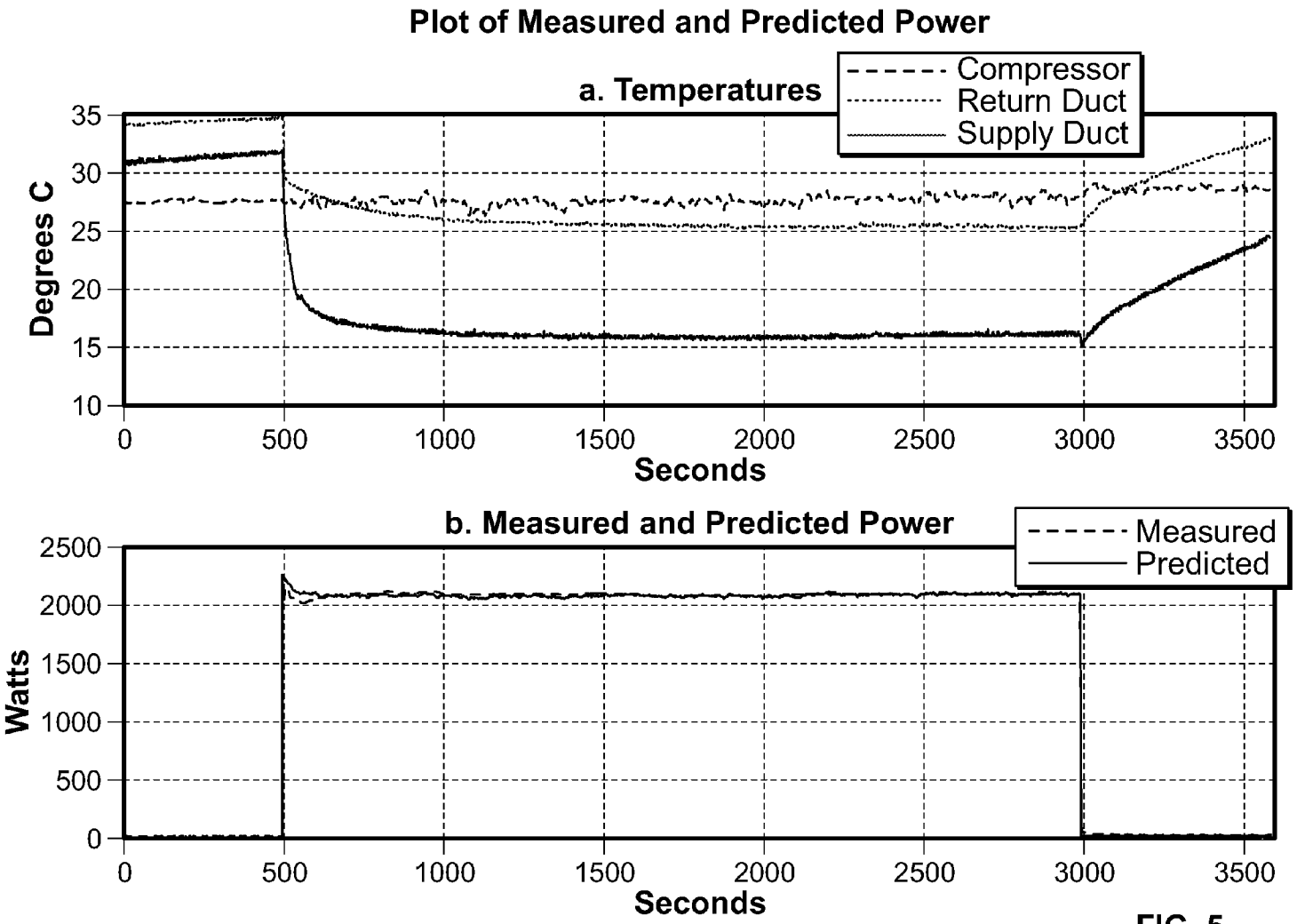
FIG. 5 illustrates an upper plot of the three temperatures from the temperature sensors of FIG. 3 versus time for one air conditioning unit over the period shown, and a lower plot of the measured real and predicted power to the compressor/condenser unit over the same time interval.

The upper diagram of FIG. 5 shows a plot of the three temperature measurements described above versus time for one air conditioning unit over the period shown, which includes an interval just before and just after the heat pumping active subcycle (HPAS). The lower diagram of FIG. 5 shows the measured real power to the compressor/condenser unit 102 over the same time interval. It is not necessary to differentiate between power delivered to the compressor/condenser unit 102 and that delivered to the air circulation fan 110 of the compressor/condenser unit 102. The power delivered to the air circulation fan 110 of a normally operating compressor/condenser unit 102 can be assumed to be constant.

For the system from which the plots of FIG. 5 were generated, the values of the constants $P_{c0}$, $k_c$, $k_r$ and $k_s$ in Equation (1) can be:

$$k_c = 25.5908\,\frac{\text{Watts}}{\text{C°.}} \tag{2}$$

$$k_r = -12.7383\,\frac{\text{Watts}}{\text{C°.}} \tag{3}$$

$$k_s = -21.2764\,\frac{\text{Watts}}{\text{C°.}} \tag{4}$$

And $$P_{c0} = 1368\ \text{Watts} \tag{5}$$

Details on how these constants can be discovered from an analysis of the data described above will be explained below. Using these values, the CIPP relation produces the predicted results shown in the lower graph of FIG. 5.

When comparing measured power against estimated power, the "normalized residual" can be calculated, defined by:

$$r(n) = \frac{P_c(n) - P_e(n)}{P_e(n)} \tag{6}$$

where $P_c(n)$ is the measured power on the nth elementary process cycle and $P_e(n)$ is that predicted by Equation (1).

Figure 6:
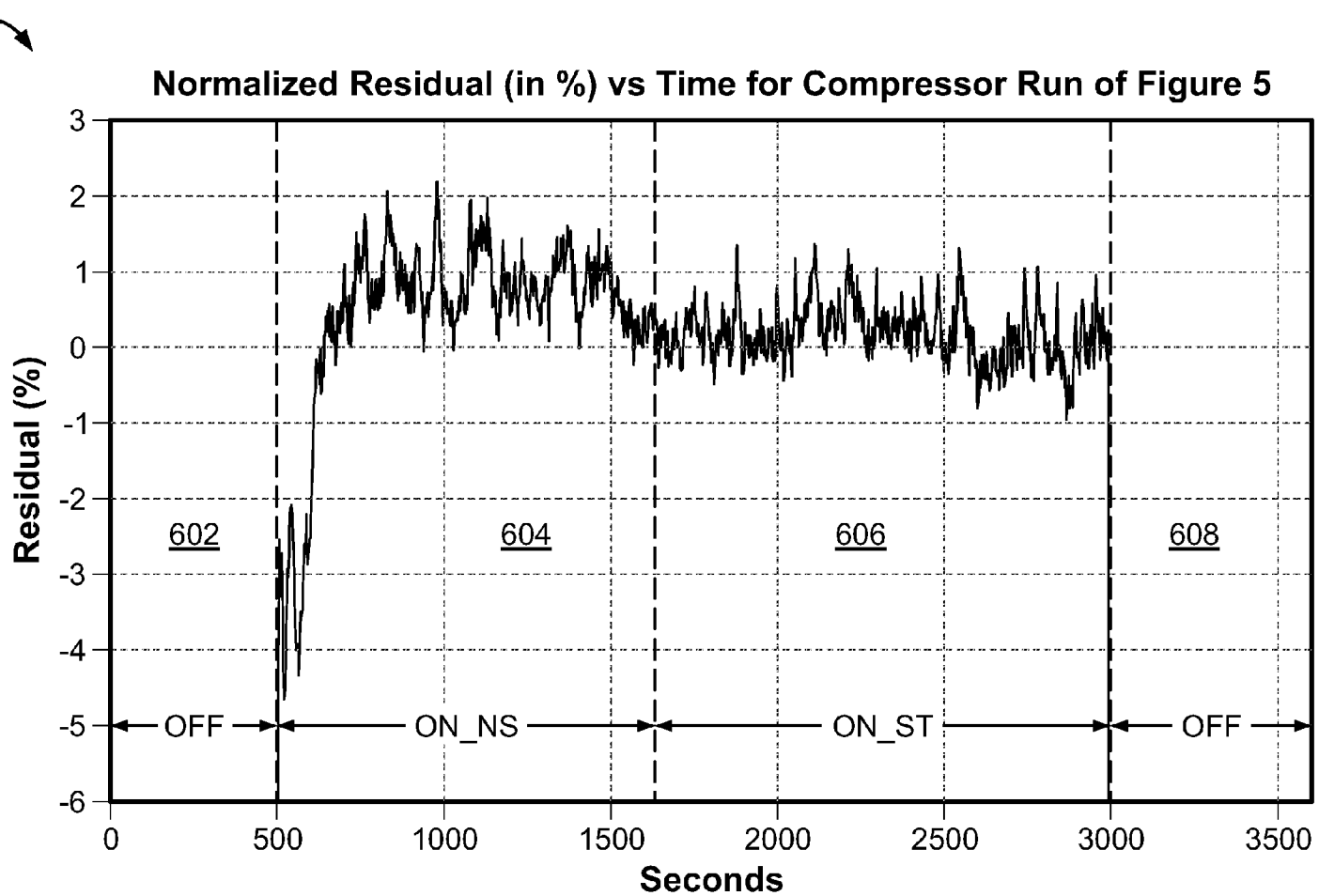
FIG. 6 illustrates a plot of normalized residual derived from the data comprising FIG. 5.

FIG. 6 shows a plot 600 of normalized residual derived from the data comprising FIG. 5. The normalized residual is expressed as a percentage by multiplying the results of Equation (7) by 100%. The plot shows four apparent regions of operation:

1. The region 602 to the far left of FIG. 6, in which the compressor is clearly "OFF" and no power is flowing. This is part of the heat pumping idle subcycle for the present heat pumping cycle.
2. A region 604 labeled ON_NS, meaning ON: Not Stable, which is the region in which the percent normalized residual is large at the beginning of an active heat pump cycle. During this interval 604, the hyperplane relation described by Equation (1) does not optimally predict compressor power, as can be seen by the large normalized residual.
3. A region 606 labeled ON_ST, meaning ON: Stable, which is a region in which the percent normalized residual may not be zero, but is relatively constant, not varying by more than about 1 percent over the entire region 606. In this region 606, the hyperplane relation described by Equation (1) predicts relatively accurately what the compressor power should be.
4. A region 608 at the tailing end of the curve labeled OFF where the residual is declared to be absolutely zero, indicating that the compressor has again turned "OFF." This region 608 is part of the next heat pumping cycle.

Regarding the transition from the ON_NS region to the ON_ST region, it is consistently observed that a VCC based system must operate for a short period of time after the compressor starts at the beginning of an HPAS for refrigerant to properly distribute within the VCC system, during which time the power computed using the CIPP relation canot be considered a valid representation of that expected of the system. This is the ON_NS region 604 described above. It is not visually clear from the data in plot 600 exactly where the ON_NS region 604 ends and region ON_ST 606 begins. A method to define and determine this transition point will be discussed later.

Figure 7:
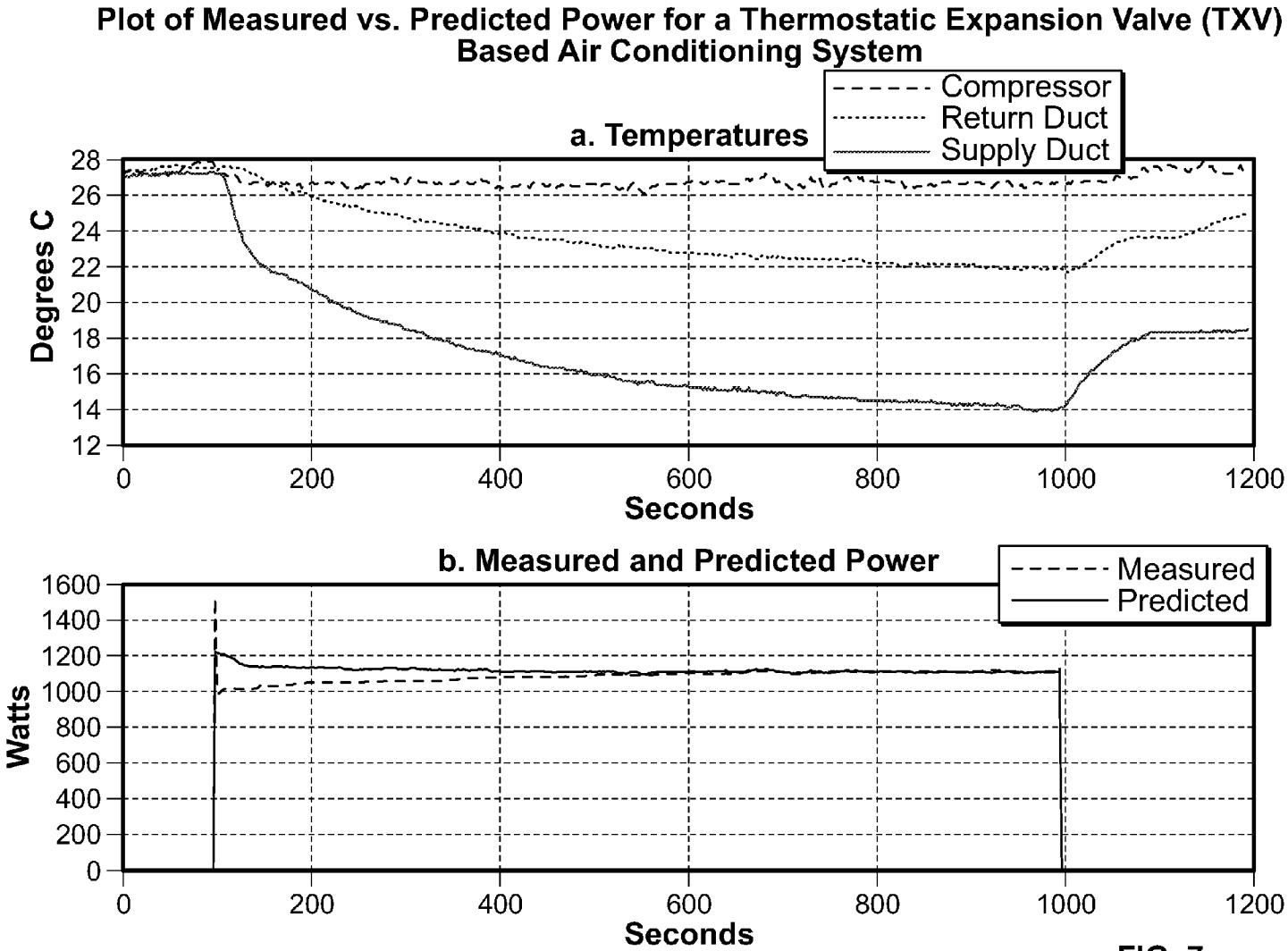
FIG. 7 illustrates an upper plot of the three temperatures from the temperature sensors of FIG. 3 versus time for a thermostatic expansion valve (TXV)-based air conditioning system over the period shown, and a lower plot of the measured real and predicted power to the compressor/condenser unit over the same time interval.
Figure 8:
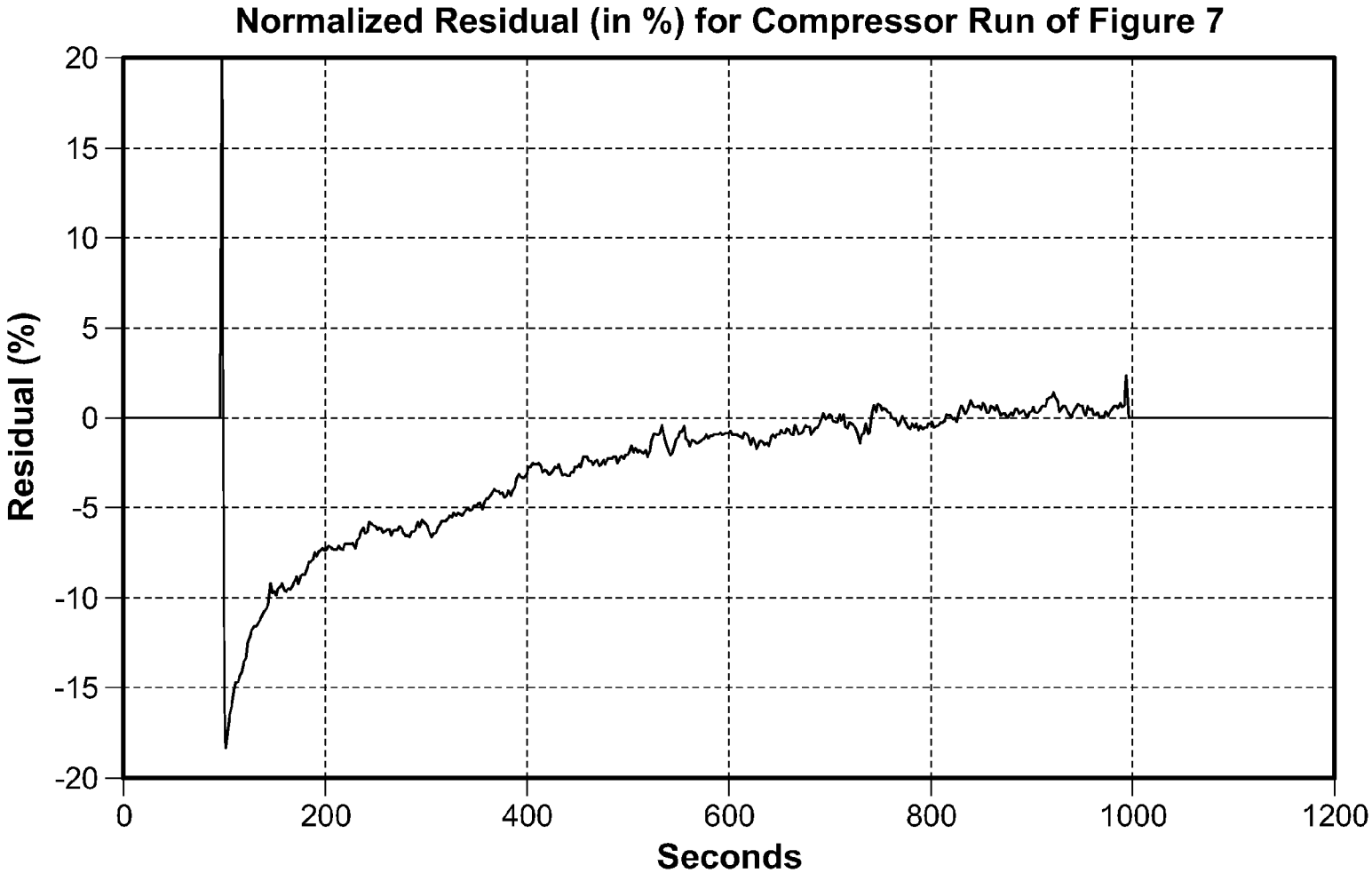
FIG. 8 illustrates a plot of normalized residual derived from the data comprising FIG. 7.

High-efficiency residential air conditioners are typically equipped with a thermostatic expansion valve (TXV), which is intended to maintain a constant value of superheat. In a manner similar to FIG. 5 and FIG. 6, FIG. 7 and FIG. 8 show measured temperatures, measured and predicted power and normalized residual in percent. In FIG. 7 and FIG. 8, predicted power was generated using Equation (1) and the following corresponding CIPP coefficient values:

$$k_c = 25.7558\,\frac{W}{\text{C°.}} \tag{7}$$

$$k_r = -15.7916\,\frac{W}{\text{C°.}} \tag{8}$$

$$k_s = -13.4069\,\frac{W}{\text{C°.}} \tag{9}$$

and $$P_{c0} = 578.8377\,W \tag{10}$$

The CIPP relation is not a sensitive function of the temperature set-point of the system, provided the compressor speed and compressor fan speed remain approximately constant, which are reasonable assumptions in a properly operating VCC-based heat pumping device utilizing single speed fans and compressor. Once the appropriate CIPP coefficient values are determined, it does not matter at what temperature the thermostat 130 is set—only the measured temperatures and power are important.

Figure 9:
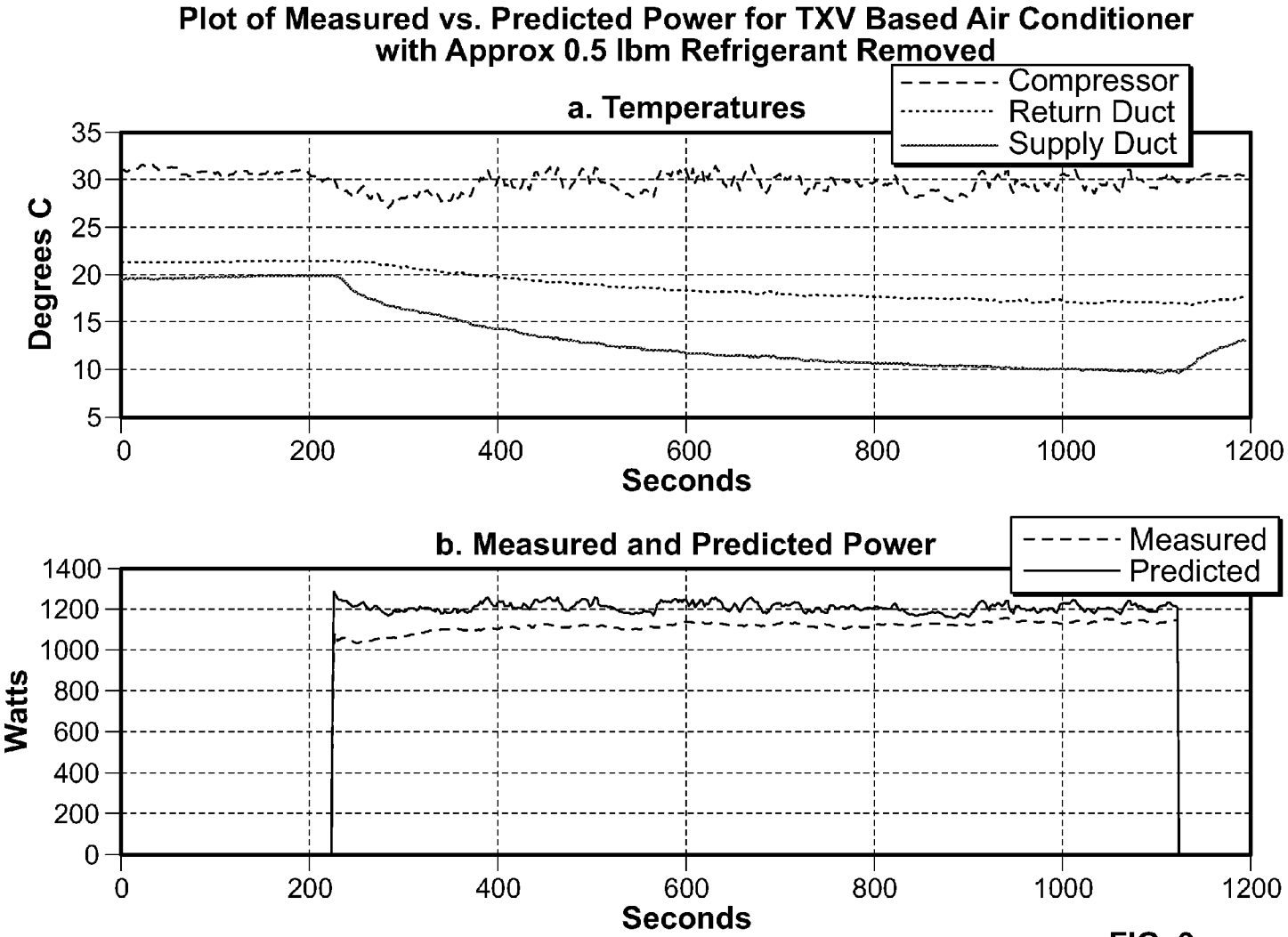
FIG. 9 illustrates an upper plot of the three temperatures from the temperature sensors of FIG. 3 versus time for a thermostatic expansion valve (TXV)-based air conditioning system over the period shown with approximately 0.5 lbm of refrigerant removed, and a lower plot of the measured real and predicted power to the compressor/condenser unit over the same time interval.
Figure 10:
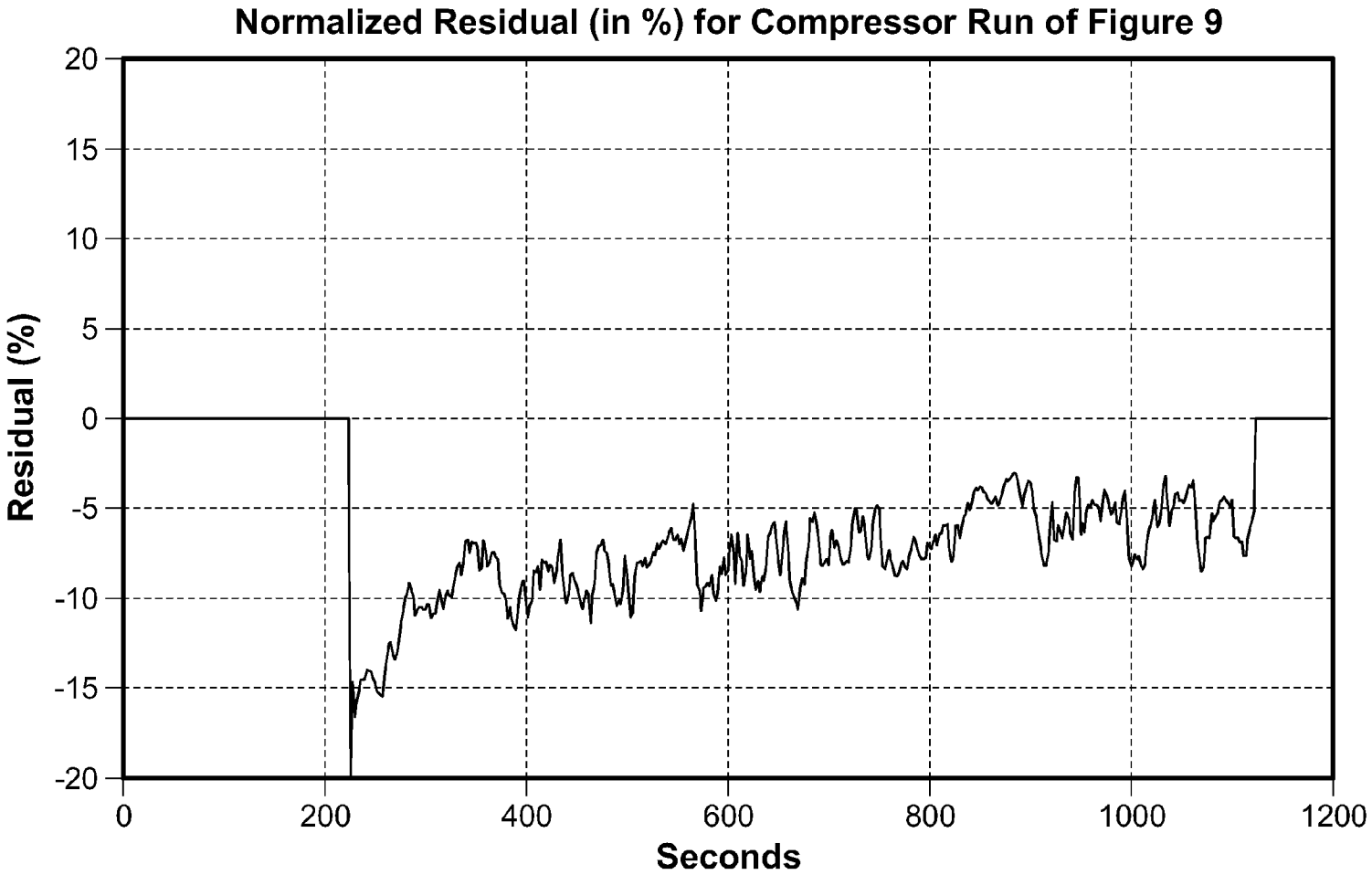
FIG. 10 illustrates a plot of normalized residual derived from the data comprising FIG. 9.

The CIPP relation is also very stable over time, provided that the air conditioner refrigerant charge mass remains constant and the system 100, 1100 (FIG. 11) is in good condition. When the air conditioner charge mass is reduced, whether intentionally or due to leakage, the power consumed by the compressor is also reduced from that predicted from Equation (1) and the degree to which the observed power is less than that predicted by the CIPP Equation (1) is an indicator of the severity of charge loss. To demonstrate this, approximately 0.5 lbm of refrigerant was removed from the air conditioning system used to generate FIG. 7 and FIG. 8, with the original "charge" (total mass of refrigerant) in the system approximately 6.5 lbm. The results of an HPAS under somewhat different temperatures (dictated by the outdoor ambient conditions at the time of the HPAS), are shown in FIG. 9 and FIG. 10. After removing the refrigerant, the measured compressor power and predicted compressor power differ by approximately 5%. This result has been found to be quite repeatable, with the difference in power a monotonic function of the charge lost. Furthermore, in this example, the effects of this loss of charge would not be felt subjectively by individuals in the air conditioned space serviced by the air conditioner. The air supplied via the supply duct would still feel "cold" to occupants, who would not necessarily recognize the loss of refrigerant. This loss of refrigerant is a type of an anomalous condition detectable from a comparison of the expected input power and the measured power from the compressor/condenser unit 102.

One can purposely use the air temperature in close proximity to the condenser coil by attaching a temperature sensing device near the condenser coil in such a manner that the sensor does not make contact with the condenser coil but at a sufficient distance to measure the temperature of the air entering the condenser coil. The CIPP relation, learned using this approach, implicitly assumes a consistent temperature relation between the air entering the condenser and the condenser surface temperature, established by a relatively constant airflow through the condenser using a single speed fan. Conditions that cause reduced airflow through the condenser cause the condenser to operate at a higher temperature than it would under normal conditions for given condenser ambient air temperature, $T_c$. This subsequently causes the compressor to use more power than predicted. An increase in measured power over that predicted by the CIPP relation indicates a reduction of heat transfer through the condenser which can be detected and reported. Two anomalous conditions that can cause a reduced heat transfer include a malfunctioning fan system or a fouled condenser. Either anomalous condition causes reduced system efficiency, and an increase in compressor power over that expected under normal conditions. One can readily diagnose these anomalous conditions visually or audibly once one is alerted to the possibility of their existence by the CIPP relation.

Another beneficial characteristic of the CIPP relation is the speed at which it becomes usable as a predictor of the state of refrigerant charge or reduced condenser heat transfer. Unlike many relations within an HVAC system that require the VCC system to thermally stabilize for long periods before the relation becomes clear, it has been observed in commercially available residential air conditioning equipment that the CIPP relation can be used reliably after only about 4 to 6 minutes of operation. Furthermore, once the system is operating in the ON_ST region of FIG. 6, the difference between measured power and excepted input power predicted by the CIPP relation is found to be substantially constant for a system that is not overcharged with refrigerant. This means that the residual described above quickly stabilizes to a constant value that is a function of the charge mass under normal conditions and the present charge mass. When the VCC system is overcharged, the compressor power is observed to fluctuate with time relative to the predicted input power under some or all ambient conditions. Using this observation, the commonly understood concept of "overcharging" can be indicated as the anomalous condition in which the magnitude of the residual relation of Equation (6) fluctuates over time when it should be constant.

Having an established CIPP relation in the general form of Equation (1) is beneficial for at least two purposes. First, it is recognized that once the appropriate refrigerant level is established in a system using conventional means of charging, and the coefficients of the CIPP relation are known, the relation can be used to predict the expected compressor input power for subsequent operation using the temperature values computed from sensory inputs responsive to the appropriate temperatures. If the expected compressor input power as computed by the CIPP relation is greater than the actual measured power of the compressor, a likely cause of this deviation is refrigerant loss, an anomalous condition that can be reported and corrected by means of system maintenance. Similarly, a fouled condenser condition can be detected as the anomalous condition in which the predicted compressor power is less than that measured. When the expected input power deviates from the measured input power by more than a predetermined tolerance, such as the tolerances provided below, an indication that an anomalous condition exists can be stored in a conventional electronic memory device. The indication can be displayed on a conventional display means, such as a video display, and optionally communicated to a device remote from the VCC system 100, 1100, such as an email system, paging or text messaging system, or a cellular phone, to name a few examples.

As a second benefit, once the CIPP relation is properly learned, it can be used as an aid in refrigerant charging during system maintenance. In a typical residential air conditioning system employing a thermostatic expansion valve, one typically employed method of establishing refrigerant charge level includes the iterative steps of:

1. Computing the subcooling of refrigerant exiting the condenser, traditionally done by measuring the temperature and pressure of the refrigerant exiting the condenser and comparing the measured temperature to an expected temperature taken from a table furnished by the air conditioner manufacturer, and looking for the proper relation between the two;
2. Making an adjustment to the refrigerant level based on the results of step or act 1 above; and
3. Waiting for the system to thermally stabilize before repeating the process.

An exemplary waiting period for the VCC system 100, 1100 to thermally stabilize is on the order of 15 minutes, from which one can estimate that each cycle of the iteration above to be on the order of 15 to 20 minutes. There can be a temptation on the part of the service technician to shorten the process, leaving the system sub-optimally charged. However, once the system has been properly charged and the CIPP relation established, on subsequent maintenance calls one can charge the system until the power predicted by the CIPP relation again matches the actual measured power. Using the CIPP relation, the power level can stabilize within 4-6 minutes, shortening the process significantly. The technician is much more likely to optimize the VCC system 100 if it can be done in a few minutes.

Monitoring and predicting compressor power using a CIPP relation is a valuable diagnostic and repair tool for refrigerant level monitoring and charging. Such a tool would provide benefits in energy efficiency, building comfort, and diagnostic and repair cost by indicating a loss of refrigerant in a timely manner before building comfort is sacrificed and providing a simple way of re-establishing refrigerant levels once the leakage is detected and repaired.

1.2 Hardware Description

The following description is offered as an example of an implementation of the present disclosure. Other variations on the implementations offered herein can be implemented without compromising the spirit and essence of the present disclosure.

Figure 11:
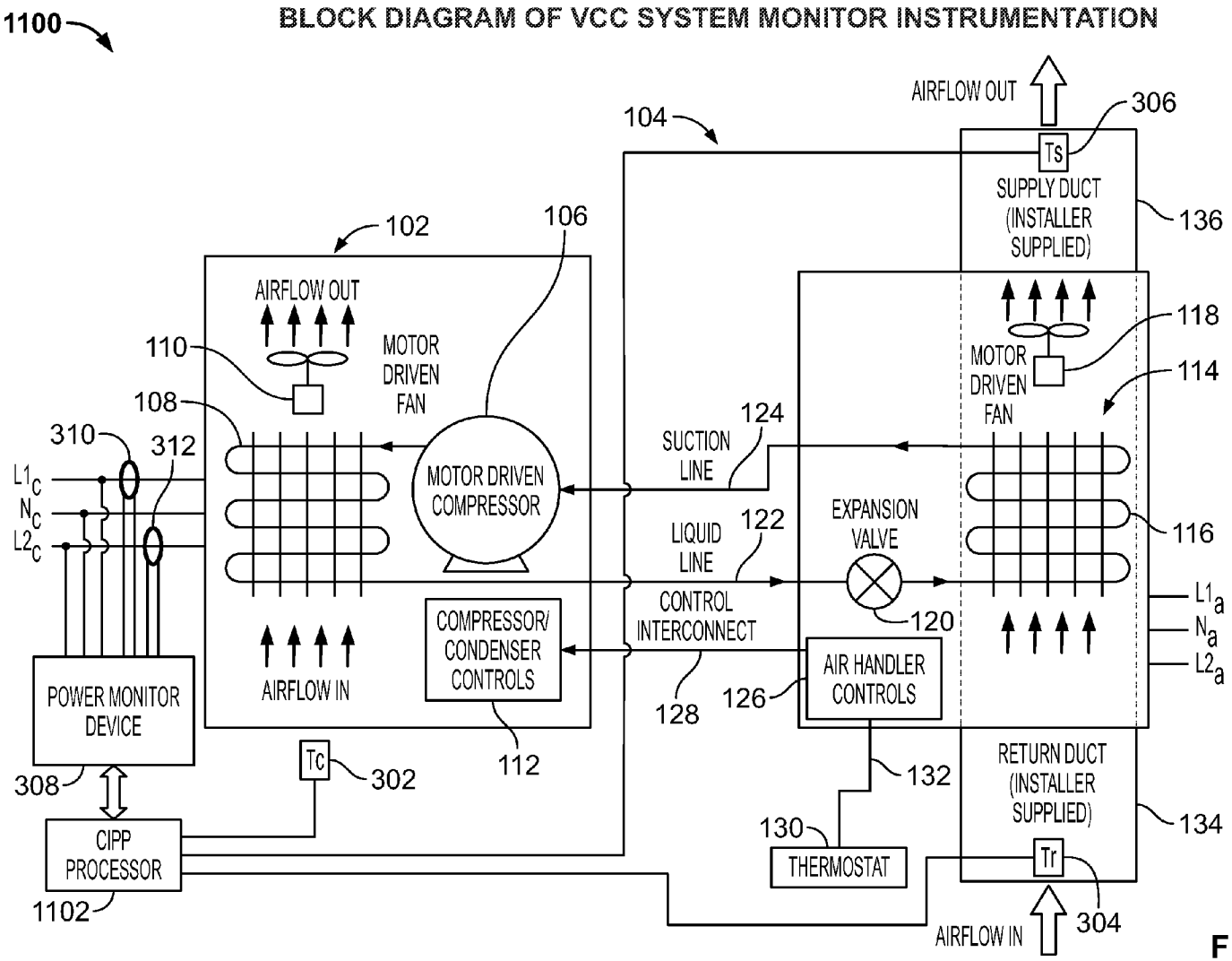
FIG. 11 illustrates a functional block diagram of a VCC-based system with compressor/condenser power and temperature monitoring instrumentation, including a CIPP processor.

The VCC-based air conditioning system 100 of FIG. 1 is augmented in FIG. 11 with a CIPP processor 1102, which is a computing device that includes some of the algorithms described herein. FIG. 11 represents a block diagram of a VCC-based system 1100 with compressor/condenser power and temperature monitoring instrumentation. The CIPP processor 1102 can be a special-purpose computer specially programmed for computing and monitoring the compressor power, or the CIPP processor 1102 can be part of another system, such as a building management system or a personal computer. For example, the CIPP processor 1102 can be a Net Controller II processor, a component of the ANDOVER CONTINUUM™ building management system manufactured by Schneider Electric (and sold under the names TAC and Andover Controls). Descriptions of the components of the VCC-based system 100 also apply to the corresponding components of the VCC-based system 1100.

Included is a monitoring device 308 for monitoring the compressor or compressor/condenser power shown in FIG. 11. For example, the monitoring device 308 can be a commercially available model PM850 power monitor, manufactured by Schneider Electric. In the embodiment described herein, two current transformers 310 and 312 are incorporated to measure the current in L1*c* and L2*c* and are connected to the power monitor device 308. Voltage connections are also made between the power monitor 308 and each power supply wire L1*c*, Nc and L2*c*. Note that while electrical connections must be made at the electrical supply to the VCC-based air conditioning unit 1100 to facilitate the system monitoring, the existing air conditioning equipment itself does not require any modification. The power monitor 308 can communicate with the CIPP processor 1102 via an industry standard communication link and protocol, such as MODBUS.

According to aspects of the present disclosure, three thermometer or temperature-sensing arrangements are included to monitor the air temperature at strategic places entering and leaving the production Compressor/Condenser 102 and Air Handler 104. The temperature sensor or thermometer module 302, labeled "Tc" in FIG. 11, communicates the measured ambient temperature of air entering condenser/compressor unit 102 to the CIPP processor 1102. An example of a suitable temperature sensor is a type-J thermocouple combined with a DataQ Model 924-MB mV/Thermocouple device. The thermocouple of this thermometer module 302 is placed on or near the exterior of the compressor/condenser unit 102, such that exterior ambient air is drawn across the thermocouple as it enters the compressor/condenser unit 102. The rest of the equipment is mounted remote from the compressor/condenser unit 102 so that it will not disturb the air flow into, nor the exhaust leaving the compressor/condenser unit 102. The DataQ Model 924-MB device converts the electrical signal developed by the thermocouple to temperature values (expressed as numbers in Degrees C.×10) and communicates these values to the CIPP processor 1102 via a communication link and protocol, such as MODBUS. The thermometer module 302 converts the signal generated by the thermocouple into a number representing the temperature in degrees C. times 10. For instance, the temperature 24.2° C. is represented by the integer value 242.

Additionally, two thermometer modules 304, 306 are positioned in the installed ductwork to provide a signal responsive to the return temperature (Tr) and the supply temperature (Ts) in the respective return and supply ducts, 134 and 136, respectively. Note again that these ducts 134, 136 are part of the installation of the system 1100 and do not intrude upon the manufactured air handler unit 104. In an implementation, the thermometer modules 304, 306 are type-J thermocouples, combined with a DataQ Model 924-MB mV/Thermocouple device, which communicates data to the CIPP processor 1102 via a communication link in a manner identical to that described above with respect to the thermometer module 302.

It should be readily apparent that a manufactured heat pump, which can operate in both heating and cooling modes can be instrumented in the same manner and operated in either the heating or cooling mode, with different CIPP relations established for each mode. In an implementation that is totally non-intrusive to the originally manufactured equipment of the VCC-based system 100, the input power to the compressor is assumed to be represented by the total input power to the condenser unit 102. It is understood that in most residential split system heat-pump or air conditioners the condenser unit 102 input power also includes the power furnished to a condenser fan 110 integral to the condenser unit 102. This additional component of power can be assumed to be constant, if the fan 110 is operating within specifications. From the CIPP relation perspective, this constant fan power appears as an increase in the term $P_{c0}$ in Equation (1) over the value that would be obtained if the compressor power were completely isolated.

1.3 Software (Algorithm) Functional Description 1.3.1 Overview

Figure 12:
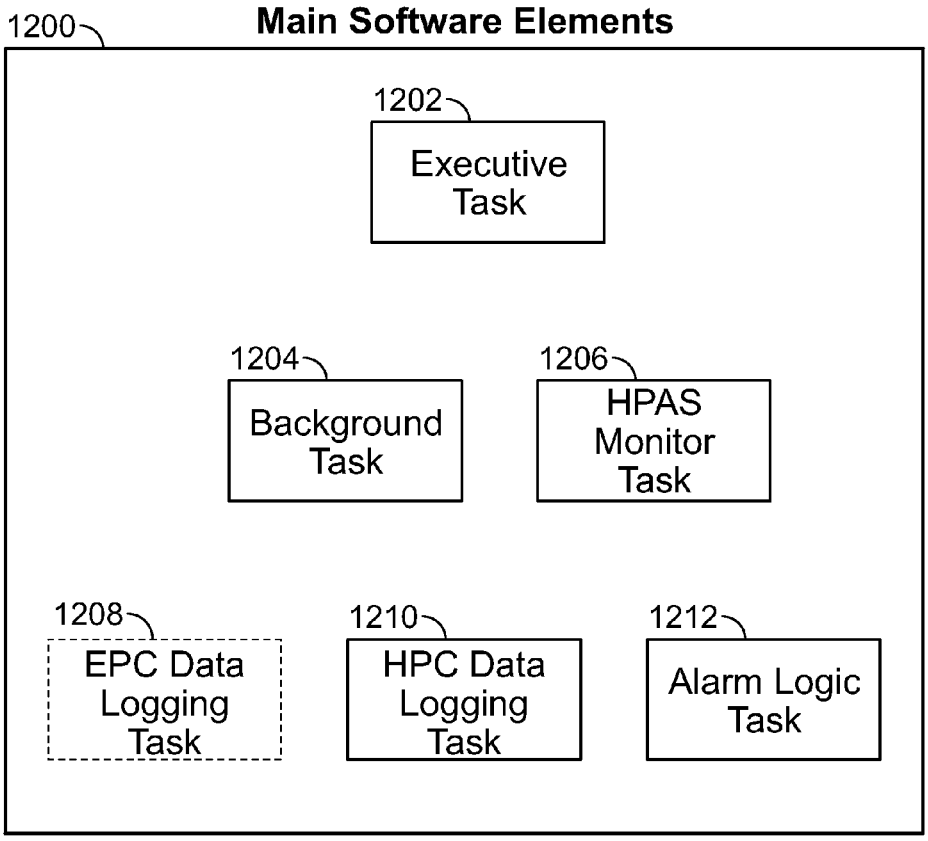
FIG. 12 illustrates primary functional components, blocks, or modules comprising computer-executable software or firmware of an aspect the present disclosure.

FIG. 12 shows primary components, blocks, or modules comprising the computer-executable software or firmware 1200 of an aspect the present disclosure. This software is resident in CIPP Processor 1102. An Executive task module 1202 manages the operation of the CIPP Processor 1102. This executive function provides an interface to the user of the system 1100 including an ability to commission the CIPP Processor 1102 and to control its operation. A large number of system-level parameters can be required to support the operation of the present disclosure. These system-level parameters are stored in a software structure referred to herein as the machine constants. The CIPP Processor 1102 provides the capability to modify the machine constants via commissioning. One machine constant sets the monitoring system mode of operation, described below.

Table 1 set forth below lists exemplary machine constants used by the software 1200 of an aspect of the present disclosure. The purpose of each machine constant is defined and described in the narrative that follows.

The Executive task module 1202 initiates an elementary process cycle (EPC). The CIPP Processor 1102 of the VCC-based system 1100 operates as a sampled data system at a rate $f_{sp}$, where $f_{sp}$ is is a machine constant defined by commissioning. Timing signals are created at intervals $\tau_{sp}$, where $\tau_{sp}$ and $f_{sp}$ are are related by:

$$\tau_{sp} = \frac{1}{f_{sp}} \tag{11}$$

The elementary process cycle, or EPC, is initiated by the Executive task module 1202 via a software semaphore to the rest of the software components, blocks or modules of the CIPP Processor 1102 at regular intervals.

As a matter of notation, if one defines a reference time t=0, at which the zero$^{th}$ elementary processing cycle begins, the time at which the n$^{th}$ elementary processing cycle begins is related to the sampling frequency by:

$$t(n) = \frac{n}{f_{sp}} = n\tau_{sp}, \quad n = 0, 1, \ldots \tag{12}$$

The index "n" refers to the elementary process cycle starting at the time t(n) given by the Equation (12), and the notion of actual time will be dropped from the remainder of this discussion. Knowing the value of "n" and the sample period, one can readily create the time at which an elementary process cycle occurred.

The software 1200 also includes a Background Task module 1204, which provides data acquisition and signal processing for the system 1100, producing a data record as part of each EPC. The data record produced by the Background Task module 1204 is required by the HPAS Monitor Task module 1206 to be described next. As such, the Background Task module 1204 is the first task executed at the start of each elementary process cycle. The operation of the Background Task module 1204 is discussed in more detail below.

The software 1200 includes an HPAS Monitor Task module 1206, which accepts the data records produced by the Background Task module 1204 and generates summary statistics for a heat pumping active subcycle or HPAS. The outputs of the HPAS Monitor task module 1206 include an HPAS Data Record, comprising a status word and two structures, all of which will be discussed in detail.

Relative to the uniform sampling rate of the CIPP Processor 1102, the start of a heat pumping active sub-cycle (HPAS), and the length of any individual heat pumping cycle (HPC) can both be considered as random variables that occur asynchronously. From the perspective of nomenclature, it is helpful in what follows to label and count heat pumping cycles and active and inactive sub-cycles associated therewith. Accordingly, the index "m" is used in what follows to indicate the $m^{th}$ heat pumping cycle, with associated idle and active subcycles beginning after the reference time t=0.

The software 1200 can include an optional EPC data logging task module 1208, which causes the data records generated by the Background Task module 1204 to be logged to an external database (not shown), for example, a set of data files on a personal computer. This data can be used for analysis purposes, or can be discarded.

The software 1200 includes an HPC data logging task module 1210, which causes the summary statistics generated by the HPAS monitor task module 1206 to be logged to an external database. This data can be used, for example, to compute energy consumption.

The software 1200 includes an Alarm Logic task module 1212, which accepts data records from the HPAS Monitor task module 1206 and applies pre-programmed logic to the data and generates alarms when appropriate, indicating the need for equipment maintenance.

1.3.2 Common Exemplary Digital Signal Processing Functions

The signal-processing aspects of the present disclosure utilize various elements, which are defined next. The present disclosure can use three processing elements, a first-in/first-out buffer or FIFO, a tapped delay version of a FIFO, called a TD_FIFO herein, and a finite impulse response filter or FIR Filter.

Figure 13:
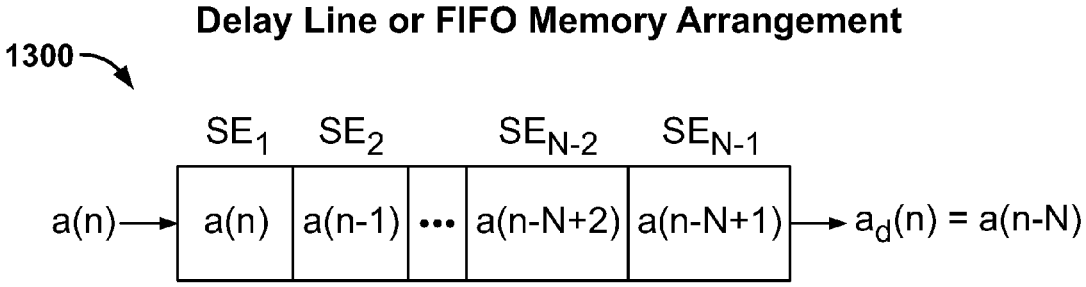
FIG. 13 illustrates a functional block diagram of a first-in/first out FIFO memory arrangement used to delay a sequence in time a(n) by N elementary processing cycles.

FIG. 13 shows a block diagram of a FIFO memory arrangement 1300 used to delay a sequence in time a(n) by N elementary processing cycles. A processor or controller allocates N−1 memory storage elements to a FIFO. These storage elements are labeled $SE_1, \ldots, SE_{N-1}$ in FIG. 13. Whenever a new sequence element is presented to the FIFO, the FIFO first presents the value in the storage element $SE_{N-1}$ as the output of the FIFO. The FIFO then moves the value stored in the storage element $SE_{N-2}$ into the storage element $SE_{N-1}$. The FIFO next moves the value stored in the storage element $SE_{N-3}$ into the storage element $SE_{N-2}$. This process continues, moving storage elements down the FIFO until the FIFO moves value of the storage element $SE_1$ into the storage element $SE_2$. Finally, the FIFO moves the present input a(n) into the storage element $SE_1$. Once this algorithm has been executed N times by the controller, and all memory storage elements contain valid sequence entries, the output sequence $a_d(n)$ is related to the input sequence a(n) by:

$$a_d(n)=a(n-N), n\geq N \tag{13}$$

These FIFO memory arrangements or sequence "delay lines" are referred to throughout the present disclosure.

There are a number of ways in which the function described above can be implemented, such as creating a FIFO delay line in electronic hardware. Those of ordinary skill in the art will appreciate that a FIFO memory arrangement can be implemented in any number of ways.

Figure 14:
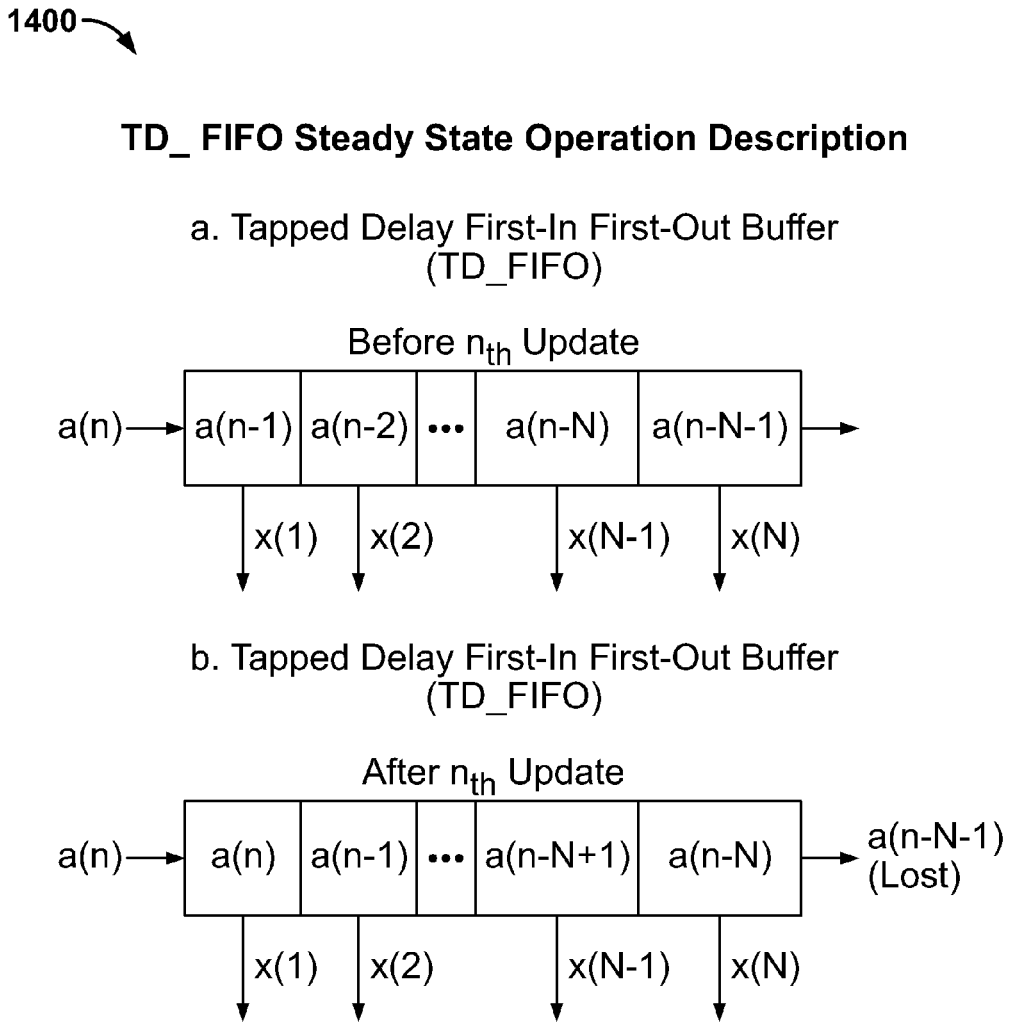
FIG. 14 illustrates a functional block diagram of a TD_FIFO, which comprises N memory elements, instead of N−1 in the case of a conventional delay line FIFO.

Another, closely related processing element that can be used in aspects of the disclosure is referred to as a tapped-delay FIFO memory arrangement, or TD_FIFO 1400. FIG. 14 shows a block diagram of a TD_FIFO 1400, which comprises N memory elements, instead of N−1 in the case of a conventional delay line FIFO. The TD_FIFO 1400 moves an input sequence through the FIFO memory arrangement in a manner identical to that of a conventional delay line FIFO, except there is no output sequence; the stored datum that would have appeared as the output $a_d(n)$ of a delay line FIFO is simply discarded. However, in the case of a TD_FIFO, the values of each storage element are available as the state variables x(1), x(2), . . . , x(N) as described, where they can be used in subsequent processing. A TD_FIFO effectively creates a moving, delayed window of the N most recent values of a sequence a(n).

Figure 15:
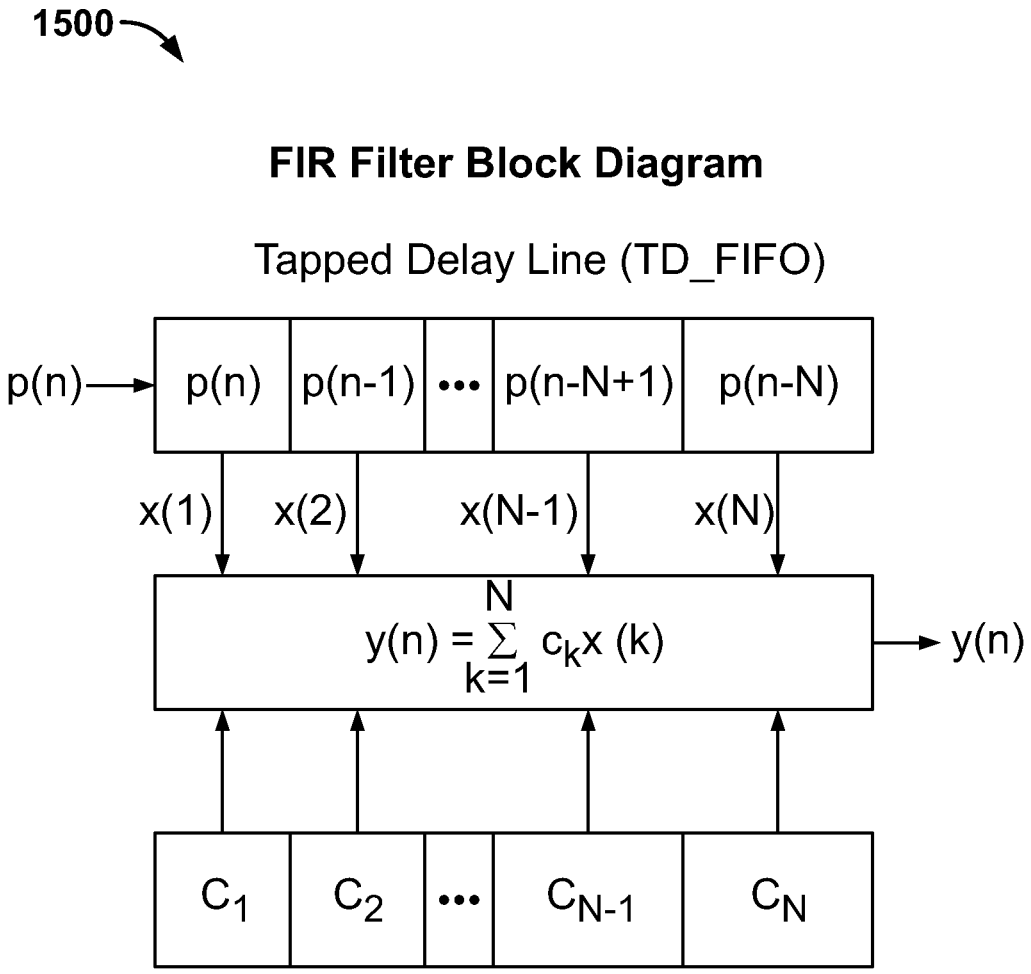
FIG. 15 illustrates a functional block diagram of an FIR filter, which makes use of a TD_FIFO, such as the one shown in FIG. 14.

The present disclosure can also make use of conventional finite impulse response (FIR) filters. FIG. 15 shows a block diagram of an FIR filter 1500, which makes use of a TD_FIFO 1400. On each elementary processing cycle, the output of the nth "tap" of the TD_FIFO 1400, x(n), is multiplied by an associated filter constant, $c_n$ and the result accumulated, resulting in an output y:

$$y=\sum_{k=1}^{N} c_k x(k) \tag{14}$$

In a special case, if each of the $c_n$ is assigned the value:

$$c_n=\frac{1}{N}, \quad n=1, \ldots, N, \tag{15}$$

the result is:

$$y(n)=\frac{1}{N}\sum_{k=1}^{N} x(k), \tag{16}$$

which is immediately recognized as the mean of the entries in the TD_FIFO 1400. Such an arrangement is often called a boxcar filter by those of ordinary skill in the art to which filters pertain, and this arrangement will be referred to as such herein.

1.3.3 Internal State Variables COMP(n), SS(n) and FS(n)

According to an example of the present disclosure, three state variable sequences can be defined and maintained by the monitoring system 1100. The CIPP processor 1102 maintains a state variable COMP(n), indicating whether the compressor 106 is running or not within the present EPC. COMP(n) takes on enumerated values in the set {TRUE, FALSE}, with "TRUE" indicating the compressor 106 is presently running and "FALSE" indicating the compressor 106 is not running Details of how the CIPP processor 1102 sets the value COMP (n) will be described below. The CIPP processor 1102 also maintains a state variable SS(n), which takes on enumerated values in the set {TRUE, FALSE}, with TRUE indicating that the CIPP processor 1102 has declared that the necessary conditions are satisfied for the system 1100 to be in the ON_ST state as shown in FIG. 6 and described above. Details of this algorithm are described below. A time delayed version of this state variable, SSd(n) is also maintained in a manner to be described below. The CIPP Processor 1102 can also maintain a state variable FS(n) indicating whether all of the TD_FIFOs employed contain a full complement of data from the present HPAS. The state variable FS(n) takes on enumerated values in the set {TRUE, FALSE} with TRUE indicating that all entries of all TD_FIFOs contain data from the present HPAS. All of these state variables are maintained on a global basis, meaning that each task has visibility to their present value at any time.

1.4 Task Descriptions

The following provides detailed descriptions of the tasks described above.

1.4.1 Executive Task

The Executive Task module 1202 includes those functions required to manage and modify the machine constants and to generate the timing signals required for the CIPP processor 1102 to operate as a sampled data system. It is the first and only task operational when the CIPP Processor 1102 is turned on and is responsible for initialization of variables and other memory structures.

From a macroscopic viewpoint, the CIPP processor 1102 can operate in two major system States: Halt or Run. In an implementation, a physical switch (not shown) can be incorporated in the system 1100 by which a user can select the state of the CIPP Processor 1102. The operation of the CIPP Processor 1102 in the Halt and Run states is described next.

1.4.1.1 Halt State

The Halt state is used to commission the machine constants used by CIPP Processor 1102. The functions used to gather data, generate alarms, predict system power, and the like are disabled in the Halt state. In an implementation, the machine constants software provides the basic operational parametric values required of the various software elements of CIPP Processor 1102. Table 1 provides a list of exemplary machine constants that can be used in the software elements of CIPP Processor 1102. The meaning and use of each machine constant will become evident as the operation of the CIPP Processor 1102 in the Run mode is described. The term "Cycles" found in Table 1 is understood to mean the number of elementary process cycles (EPC).

TABLE 1

Machine Constants

| Structure Element | Description | Default Value | Units | Notes |
|---|---|---|---|---|
| Mode | System Mode | Mode0 | | Enumerated value in set {Mode0, Mode1, Mode2} |
| $f_{sp}$ | Sampling Frequency | 0.5 | Hz. | |
| $N_{td}$ | Number of storage entries in the TD_FIFOs | 64 | Units | |
| DBCref | Debounce Count for compressor ON/OFF determination | 5 | Cycles | |
| $P_{th}$ | Compressor On/Off power threshold. | 0 | Watts | |
| $P_{c0}$ | CIPP Coefficient - Power Offset | 0 | Watts | |
| $k_c$ | CIPP Coefficient - sensitivity to compressor inlet temperature | 0 | Deg C. | |
| $k_r$ | CIPP coefficient - sensitivity to return temperature | 0 | Deg C. | |
| $k_s$ | CIPP coefficient - sensitivity to supply temperature | 0 | Deg C. | |
| $N_d$ | Sequence Delay Length | 10 | Cycles | |
| $STD_{max}$ | Maximum standard deviation of SS detect | 5 | Percent | |
| $Magm_{max}$ | Maximum slope magnitude of normalized residual regression | 5 | Percent | |
| MaxHPASCount | Maximum length of an HPAS | 5400 | Cycles | Corresponds to 3 hours of run time at 0.5 Hz sample rate |
| SSMode1_Delay | Delay between detected start of HPAS and declaration of SS(n) TRUE in Mode1 | 180 | Cycles | Corresponds to 6 minutes of run time at 0.5 Hz sample rate |
| $r_{ffth}$ | Fan failure threshold | 1.5 | None | Fan failure alarm generated if normalized residual exceeds this value |
| $r_{rfth}$ | Loss of Refrigerant Alarm Threshold | .75 | None | Loss of refrigerant alarm set if normalized residual is less than this value. |

1.4.1.2 Run State

In the Run state, the CIPP Processor 1102 operates in one of three system Modes, specified by the Mode machine constant listed in Table 1. The system mode is managed by a commissioning tool with the CIPP Processor 1102 in the Halt state. The Mode machine constant takes on one of three enumerated values in the set {Mode0, Mode1, Mode2}. These values define a hierarchy of system operation, from minimal functionality in Mode° to full functionality in Mode2 as described below.

With CIPP Processor 1102 in the Run state, the lowest functionality operating mode is Mode0. In Mode0, the CIPP Processor 1102 can only measure the temperatures $T_c$, $T_s$ and $T_r$ and the compressor/condenser unit 102 input power $P_c$. It is not capable of determining the predicted compressor power, or even to determine whether the compressor is on or off without additional information. This mode represents the "out of the box" mode of the machine.

The CIPP Processor 1102 can be enabled to operate in Mode1 after supplying the system with the values of two machine constant parameters: a power threshold value, $P_{th}$; and a holdoff delay SSMode1_Delay, described in more detail below. These values are set by commissioning with the CIPP Processor 1102 in the Halt state.

In Mode1, the CIPP Processor 1102 can determine when the compressor/condenser 102 is ON or OFF using the machine constant power threshold $P_{th}$, and the HPAS Monitor Task module 1206 can utilize the holdoff delay machine constant SSMode1_Delay to generate statistical information useful for determining the values of the CIPP coefficients $P_{c0}$, $k_c$, $k_r$ and $k_s$.

The CIPP Processor 1102 can be enabled to operate in Mode2 by satisfying the conditions required to operate in Mode1 and setting the values of the CIPP coefficient machine constants $P_{c0}$, $k_c$, $k_r$ and $k_s$ by commissioning with the CIPP Processor 1102 in the Halt state. Mode2 is the normal, monitoring mode of the CIPP Processor 1102. When in Mode2, the CIPP processor 1102 and the associated software described herein can determine whether the compressor 106 is ON or OFF, and can also perform digital signal processing described below to determine when the HPAS is in the ON_ST state described in FIG. 6 using an algorithm to be described later. While the HPAS is in the ON_ST state the CIPP Processor 1102 performs digital signal processing and statistical analysis on the measurements and predictions made by the CIPP relation. These are used by the Alarm Logic task module 1212 to determine the deviation of the system 1100 from the nominal condition and to generate alarms as appropriate When the CIPP Processor 1102 is placed in the Run state, the Executive Task module 1202 initializes the values of all the machine constants. Each machine constant can be provided with a hard-coded default value, and a stored, commissioned value, which a technician or other skilled operator can modify by commissioning with the CIPP Processor 1102 in the Halt state. When possible, the CIPP Processor 1102 utilizes the commissioned value of the machine constants, using the hard-coded default values when no commissioned values are present. Having initialized the machine constants, the Executive task module 1202 initializes all data structures except the machine constants in the CIPP Processor 1102, and computes the period of the elementary process cycle, utilizing the sampling rate machine constant value of $f_{sp}$. It then sets up the timing mechanism by which an EPC semaphore is created, indicating the beginning of each elementary process cycle. Once the timing mechanism has been initialized, the Executive Task module 1202 generates the semaphore at the appropriate times.

1.4.2 Background Task

Figure 16:
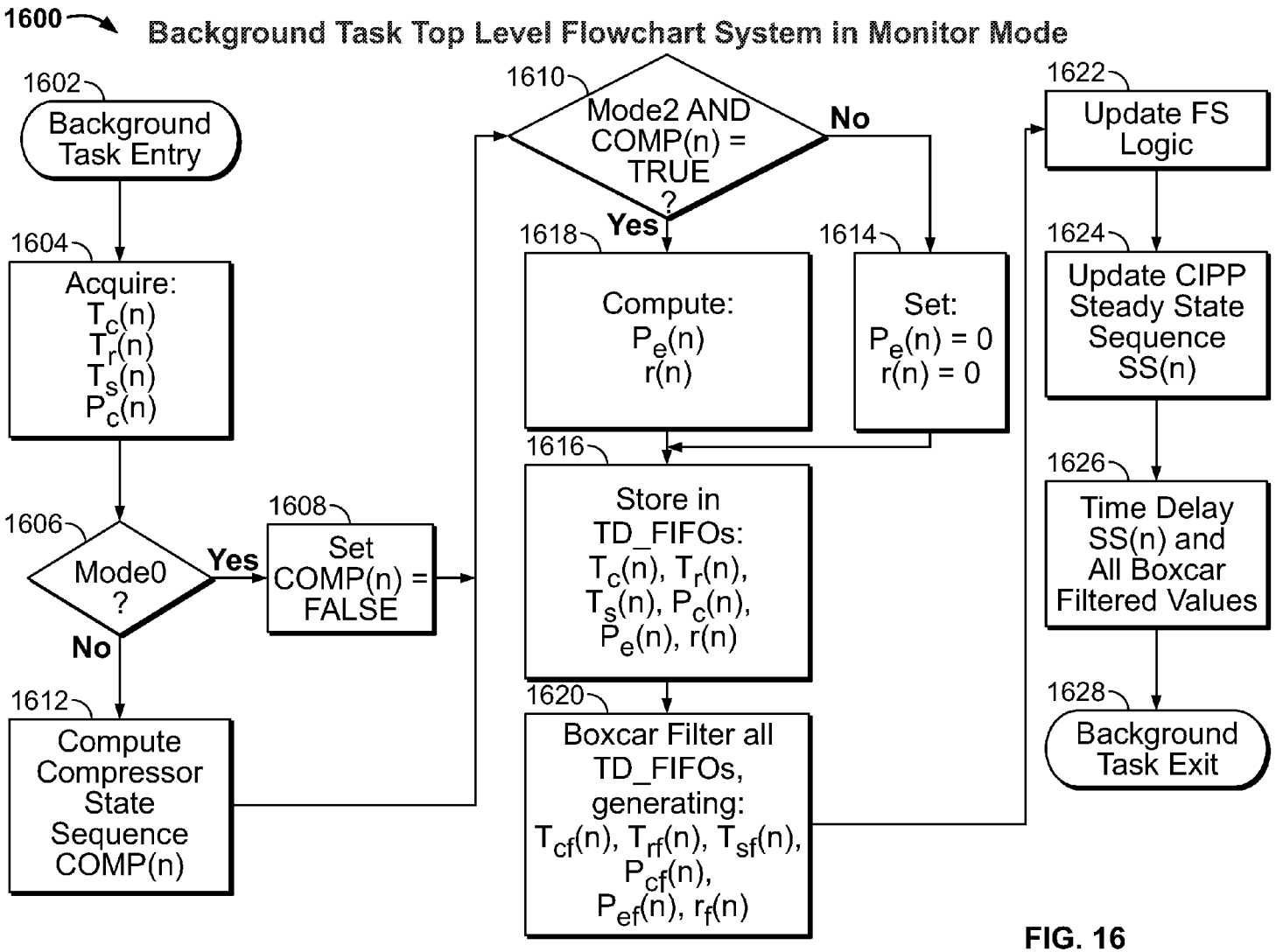
FIG. 16 illustrates a top-level flowchart of an algorithm performed by the Background Task module shown in FIG. 12, which is initiated each time an EPC semaphore is received from the Executive task module.

FIG. 16 illustrates a top-level flowchart of an algorithm 1600 performed by Background Task module 1204, which is initiated each time an EPC semaphore is received from the Executive task module 1202. Upon entry into the Background Task module 1202 (1602), the CIPP processor 1102 retrieves the most recent sample data values from the sensory elements (1604), including $P_c$, the average condenser unit or compressor power over the previous sampling interval, and the three temperature measurements, $T_c$, $T_r$ and $T_s$, and assigns the values to the sequences $P_c(n)$, $T_c(n)$, $T_r(n)$ and $T_s(n)$, where n is an index denoting the $n^{th}$ elementary sample period since a reference time. Note that the value "n" is incorporated herein to reinforce the implication that a sequence of values is measured, generated, etc. It is a mathematical convenience only to facilitate a description of how the algorithms work and what they do. The user of the CIPP Processor 1102 never actually "sees" a value n, nor is it maintained internally per se. After acquiring the input data a test is made to determine if the CIPP Processor 1102 is presently operating in Mode0 (1606). If the CIPP Processor 1102 is in Mode0, the control passes to process block 1608, where the state sequence COMP(n) is set FALSE. Control then passes to decision block 1610. If the CIPP Processor 1102 is not operating in Mode0, the CIPP processor 1102 determines and assigns the compressor state COMP(n) (1612), utilizing an algorithm discussed below, and control is passed to the decision block 1610.

Two logical tests are made in decision block 1610. A test is made on the result of processing in block 1612 to determine whether the present value of COMP(n) is TRUE, meaning that the compressor 106 is declared to be "ON" by the CIPP processor 1102. A test is also made to determine if the CIPP Processor 1102 is operating in Mode2, meaning valid CIPP coefficients have been provided the CIPP Processor 1102. If the answer to either test is "No," the CIPP processor 1102 sets the present values of the sequences $P_e(n)$ and r(n) defined above to zero (1614), and proceeds to process block 1616. If in decision block 1610, COMP(n) is TRUE and valid CIPP coefficients have been defined, indicated by operation in Mode2, control proceeds to the process block 1618, where the CIPP processor 1102 computes the values of $P_e(n)$ and r(n) using Equations (1) and (6) above, and control is passed to the process block 1616.

In process block 1616, the present value of each of the sequences in the Sequence column of Table 2 set forth below is stored in an individual TD_FIFO 1400, dedicated to that variable. The CIPP processor 1102 maintains boxcar filters 1500 for each of the sequencese, using the values in the TD_FIFO's 1400 already updated. The resulting associated sequences are shown in the "Resulting Filtered Sequence" column of Table 2 below. In the process block 1620, the boxcar filter values are updated utilizing the results of process block 1616 as inputs. Equation (16) forms the basis for computation of each of these filtered sequences.

Control proceeds to the process block 1622 where the CIPP processor 1102 executes logic to determine whether the TD_FIFOs maintained by the CIPP Processor 1102 are full of valid data taken from a present HPAS. The result of this logic is the state variable FS(n), which takes on values in the enumerated set {FALSE, TRUE}, where a logical value "TRUE" indicates that all TD_FIFOs contain valid data from a present HPAS and FALSE means they do not. The logic executed to determine the value of FS(n) for an elementary process cycle is discussed below.

Control passes to process block 1624, where the present value of steady state sequence SS(n) is updated, with details of this process to be discussed below.

The CIPP processor 1102 maintains time-delayed, individual FIFO delay lines of length $N_d$ as described above, for each of the boxcar filtered sequences in Table 2, and for SS(n), in process block 1626. The resulting, time-delayed sequence of SS(n) is referred to as $SS_d(n)$, with $N_d$ being a machine constant determined by commissioning. The time-delayed versions of each of the boxcar filtered values are given in Table 2 under the heading "Delayed Filtered Sequence." The purpose of these buffers and their length is discussed below. Following the update of these FIFO delay lines in block 1626, the Background Task ends (1628).

TABLE 2

Boxcar Filtered Sequences

| "Raw" Sequence | Sequence Description | Resulting Filtered Sequence | Delayed Filtered Sequence |
|---|---|---|---|
| $T_c(n)$ | Compressor/Condenser Inlet Air Temeprature (302) | $T_{cf}(n)$ | $T_{cfd}(n)$ |
| $T_s(n)$ | Air Handler Supply Duct Temperature (306) | $T_{sf}(n)$ | $T_{sfd}(n)$ |
| $T_r(n)$ | Return Duct Air Temperature (304) | $T_{rf}(n)$ | $T_{rfd}(n)$ |
| $P_c(n)$ | Measured Compressor/Condenser unit input power | $P_{cf}(n)$ | $P_{cfd}(n)$ |
| $P_e(n)$ | Estimated (predicted) Compressor/Condenser unit input power using CIPP relation | $P_{ef}(n)$ | $P_{efd}(n)$ |
| r(n) | Normalized residual of compressor power. See Equation (7) for definition | $r_f(n)$ | $r_{fd}(n)$ |

An exemplary method in which the CIPP processor 1102, operating in Mode1 or Mode2 determines the value of the state variable COMP(n), indicating whether the compressor is in the "ON" or "OFF" state will be described next. This is designated as process block 1612 in FIG. 16. The input power to the condenser unit is measured and compared against the value of a threshold machine constant $P_{th}$, set by commissioning. With the power threshold value $P_{th}$ established, an instantaneous ON/OFF state variable, X(n) can be constructed on each elementary process cycle by comparing the present value of the power sequence, $P_c(n)$, against the pre-programmed threshold, $P_{th}$. It is customary to "debounce" the ON/OFF status indication to ensure that the occasional noise in the power measurement cannot cause the state variable to change spuriously. The debounce algorithm used here requires that when the measured power crosses the threshold from low to high (or high to low), it must remain high (or low, as the case may be) for a specified number consecutive sample periods before a change is declared in the internally maintained ON/OFF state represented by COMP(n).

Figure 17:
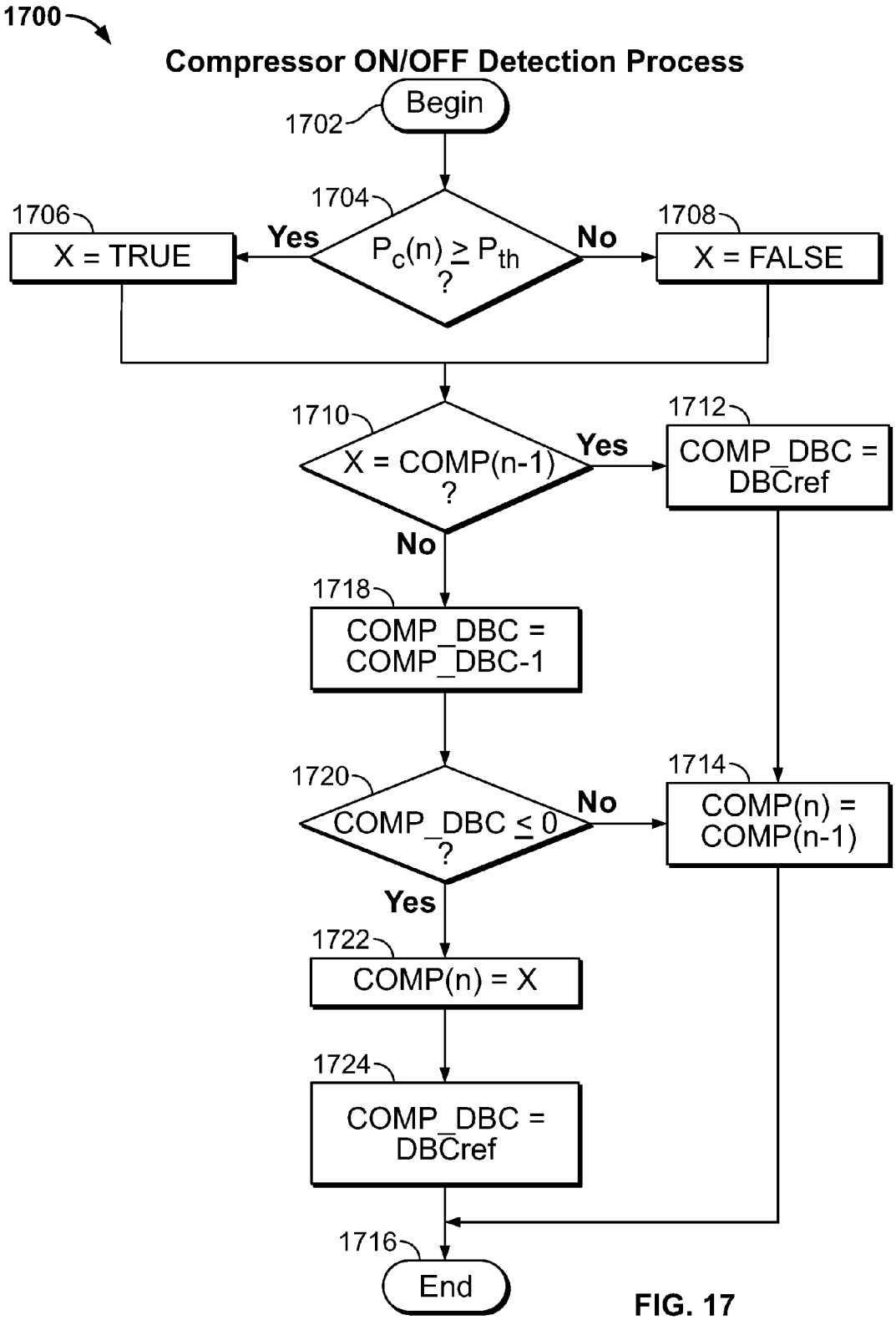
FIG. 17 is a flowchart showing a compressor state-detection algorithm for detecting the state of the compressor.

FIG. 17 is a flowchart showing a compressor state-detection algorithm 1700 for detecting the state of the compressor. The output of the algorithm 1700 is a state variable sequence COMP(n), indicating whether the compressor 106 is in the ON (indicated by TRUE) or OFF (indicated by FALSE) state. A debounce counter, COMP_DBC, is maintained by the algorithm 1700 and used to determine when it is acceptable to change the estimated system state COMP(n). A constant positive integer value, DBCref, is used to determine when to change the state value of COMP(n) in a manner described below. DBCref is a machine constant, the value of which can be set in the CIPP Processor 1102 in the Halt state by commissioning. A typical value of DBCref is on the order of five elementary process cycles, which at a sampling rate of 0.5 Hz means that the compressor must be on for ten seconds before the CIPP processor 1102 declares it to be "ON." Similarly, in transitioning from the ON state to the OFF state, a delay of ten seconds can be incurred.

Upon entry to the compressor ON/OFF detection process at (1702), the newest value of the condenser power sequence, $P_c(n)$, is immediately compared (1704) against the predetermined threshold value, $P_{th}$ described above. As a result of the comparison, the intermediate variable X is assigned the value TRUE (1706) if the present power measurement $P_c(n)$ is greater than or equal to $P_{th}$ and the value FALSE (1706) if the present power measurement is less than $P_{th}$.

The value of the local variable X is compared against the previous compressor state value COMP(n−1) (1710), the value of COMP(n) generated in the previous elementary processing cycle. If X has the same value as COMP(n−1), the debounce counter DBC is assigned the machine constant value DBCref (1712), the new value of COMP(n) is assigned the previous value COMP(n−1) (1714), and this cycle is complete and control exits (1716). If X and COMP(n−1) are not equal as a result of the comparison in block 1710, it may be time to change the value of the internal compressor state COMP(n). In this case, the debounce counter, COMP_DBC is decremented by one count (1718). The resulting value of COMP_DBC is compared to zero (1720). If the debounce count is not yet zero or negative, it is not yet time to change the declared state of the system, and COMP(n) is assigned the previous value COMP(n−1) (1714). Following this assignment, the state manager process ends by exiting (1716) as shown, and the COMP_DBC variable retains the newly decremented value.

If, in decision block 1720, the value of the debounce counter COMP_DBC is detected to be less than or equal to zero, it is time to change the internal system level declaration of the compressor state, COMP(n). COMP(n) is assigned the present value of the local state variable X (1722). The debounce counter COMP_DBC is assigned the default value DBCref (1724), and the algorithm 1700 exits (1716).

As should be clear from the description above, for the compressor ON/OFF detection process to declare a transition from the ON (TRUE) state to the OFF (FALSE) state, the actual power to the compressor must have dropped below the threshold value $P_{th}$ for DBCref consecutive elementary processing cycles. Assuming the value of $P_{th}$ has been properly selected, this means that power must have been physically removed from the compressor/condenser unit 102 for at least a number of consecutive elementary processing cycles corresponding to DBCref. A method to select an appropriate value of $P_{th}$ will be discussed later.

1.4.3 FIFO State Variable FS(n)

Next, the processing required to update the FS state variable in block 1622 of FIG. 16 is presented. To accomplish this, the CIPP Processor 1102 maintains a counter, FSCount, the significance of which depends upon the mode of the CIPP Processor 1102 as defined by the value of the Mode machine constant. In Mode0, FSCount is used to keep track of elementary process cycles since initialization. In Mode1 or Mode2, FSCount keeps track of the number of consecutive cycles for which COMP(n) has been declared "TRUE". In both cases, FSCount is limited to the length of the TD_FIFO arrays, defined by a machine constant $N_{td}$. A typical value of $N_{td}$ is 64 elements, which corresponds to a window of 128 seconds at an elementary sample period of 0.5 Hz.

Figure 18:
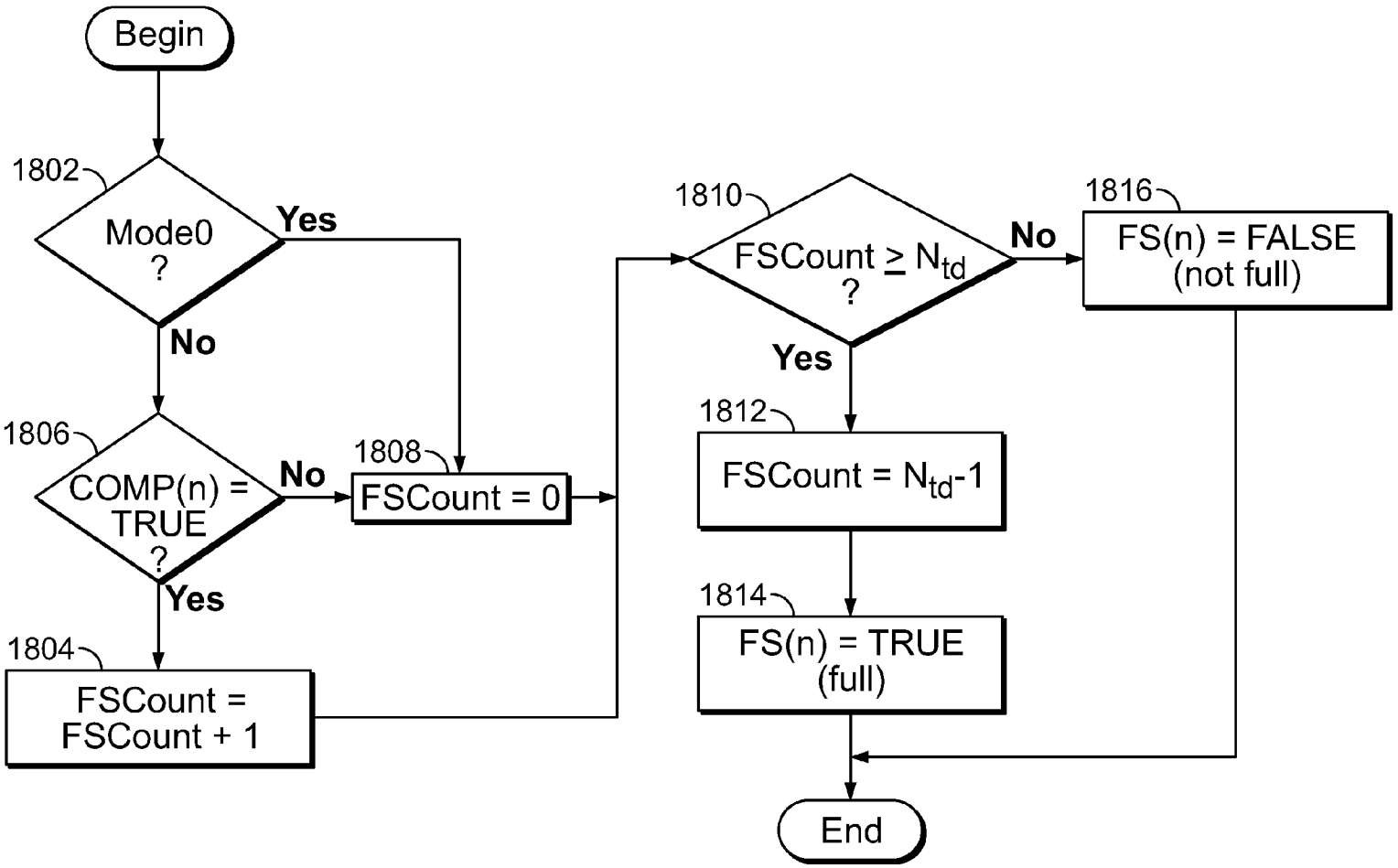
FIG. 18 illustrates a FIFO state variable algorithm.

Referring now to FIG. 18, a FIFO state variable algorithm 1800 is shown. A decision block 1802 checks to see whether the CIPP Processor 1102 is in Mode0, indicating that the commissioning has not yet been performed to establish the criteria to determine if the compressor/condenser unit 102 is "ON" or "OFF." If the CIPP Processor 1102 is in Mode0, control passes to process block 1808, where FSCount is set to zero. If not, control passes to decision block 1806, which examines the present value of the variable COMP(n), already determined for this elementary processing cycle. If COMP(n) is not TRUE, the routine sets FSCount to zero in process block 1808 and control transitions to decision block 1810. If COMP(n) is determined to be TRUE (1806), control passes to process block 1804.

In process block 1804, the present value of FSCount is increased by 1. This count indicates the number of elementary process cycles since the COMP(n) variable was first set TRUE, following a previous FALSE value. After incrementing FSCount, control passes to decision block 1810.

In decision block 1810, the present value of FSCount is compared against the threshold value, $N_{td}$. In Mode0, the routine will never achieve this value, FSCount having been set to zero in process block 1808. If FSCount is greater than or equal to $N_{td}$, all TD_FIFOs are full of entries for which the corresponding compressor state COMP(n) is TRUE.

In this case, FSCount is set to the value $N_{td}$-1 in process block 1812. This is done for practical purposes to ensure that FSCount does not get too large. In a computer with a fixed number of bits representing an integer, it is possible to overflow the storage element storing the integer, with undesirable results. Following the process block 1812, the value of FS(n) is declared TRUE meaning "full" in process block 1814, and the routine ends. If in block 1810, FSCount is not greater than or equal to N, the values in the TD_FIFOs do not represent $N_{td}$ consecutive entries for which COMP(n) was TRUE. In this case, FS(n) is assigned the value FALSE, meaning "not full" in process block 1816, and the routine ends.

1.4.4 Computation of CIPP Steady State Variable SS(n)

The state variable SS(n) keeps track of whether the VCC system is operating in the steady state, as defined by criteria described above. The means to compute the variable SS(n) depend on the operating mode of the monitoring system.

In Mode0, the ON/OFF threshold $P_{th}$ of the compressor is not yet fixed, hence the compressor ON/OFF state variable COMP(n) cannot reliably be determined. In this case the variable SS(n) is always assigned the value FALSE. In Mode1 the ON/OFF threshold $P_{th}$ of the compressor has been set at commissioning, but the coefficients of the CIPP relation have not yet been fixed. The steady state variable SS(n) is initialized at FALSE, then is set to TRUE once a specified number of elementary process cycles have passed after the FIFO buffers first contain a full set of data from the present HPAS.

Figure 19:
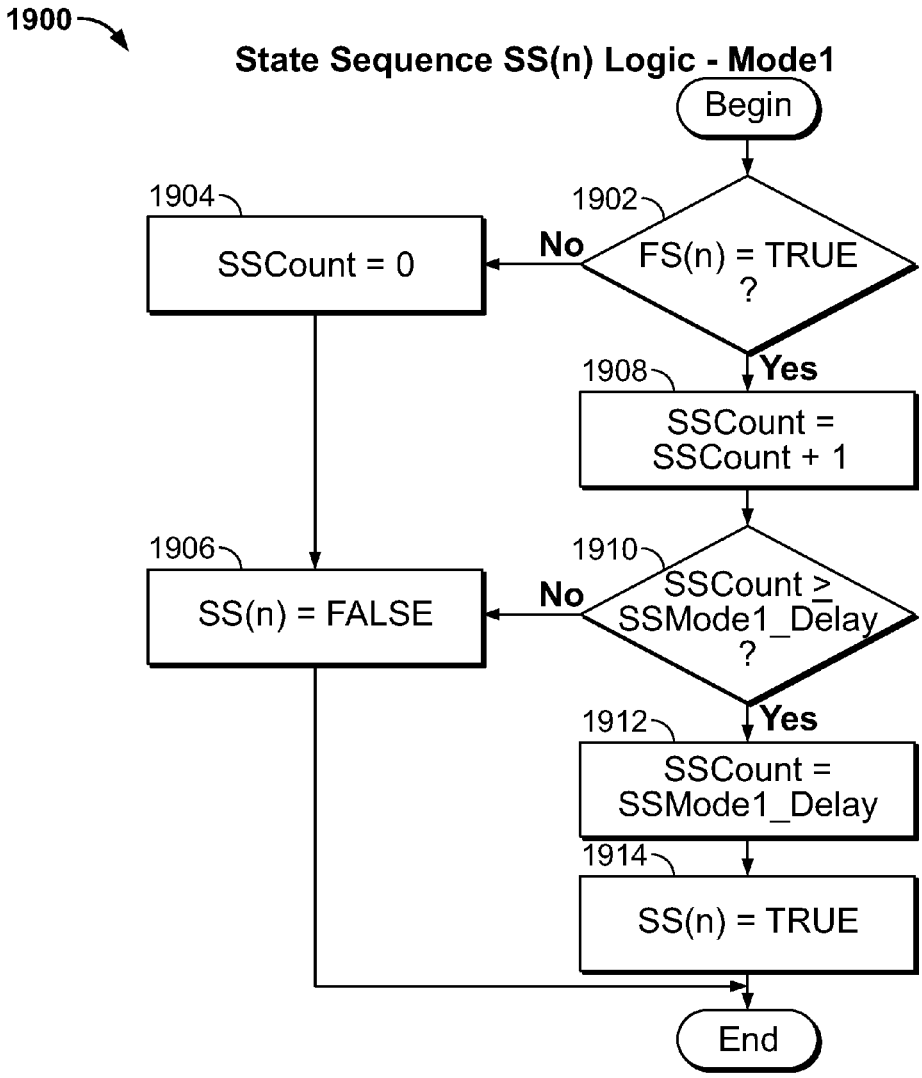
FIG. 19 illustrates a flowchart of a state sequence logic (Mode1)

FIG. 19 shows the logic used to determine the value of SS(n) when the monitoring system operates in Mode1. At entry to the algorithm, the variable FS(n) is evaluated. If FS(n) is not TRUE (i.e., is FALSE indicating that the FIFO buffers are not filled with valid data) the variable SSCount is set to zero in 1904, the state variable SS(n) is set to FALSE in 1906, and the function ends. If FS(n) is TRUE in 1902, the variable SSCount is incremented in 1908, and compared with the machine constant SSMode1_Delay in 1910. If SSCount is less than SSMode1_Delay, control passes to block 1906 where SS(n) is set to FALSE, and the function exits. If SSCount is equal to or greater than SSMode1_Delay in 1910, control passes to 1912 where SSCount is set equal to SSMode1_Delay. This is done for practical purposes to ensure that SSCount does not get too large. In a computer with a fixed number of bits representing an integer, it is possible to overflow the storage element storing the integer, with undesirable results. Control passes to block 1914 where SS(n) is set to TRUE, and the function 1900 exits.

Figure 20:
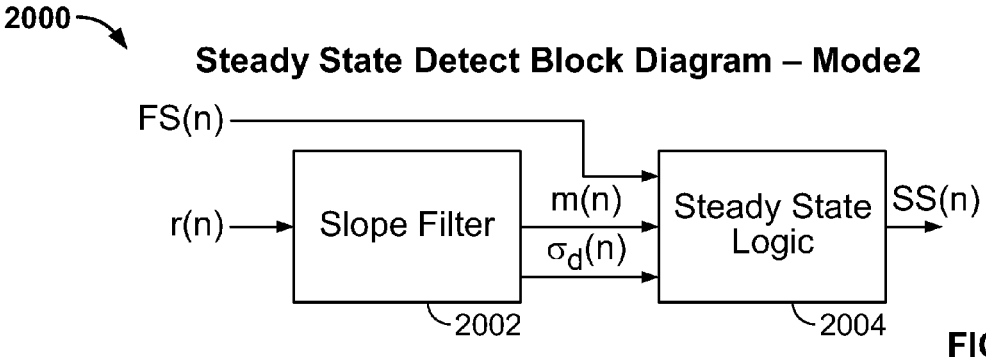
FIG. 20 illustrates a functional block diagram of exemplary processing elements for computing the steady-state detect state variable.

In Mode2, where the compressor/condenser ON/OFF threshold value and the CIPP coefficients are provided, the steady state variable SS(n) is computed based on the residual between the measured and expected or predicted compressor power. FIG. 20 shows a block diagram 2000 of processing modules for computing the steady-state detect state variable. On the nth elementary process cycle, if the compressor 106 is declared to be in the ON state by virtue of the state variable COMP(n) set TRUE and if valid CIPP coefficients have been provided to the CIPP Processor 1102, the Background Task algorithm 1600 computes the normalized residual, r(n), between the measured compressor power, $P_c(n)$ and the estimated compressor power $P_e(n)$ per Equation (6). This normalized residual r(n) is one input to Slope Filter processing element 2002 shown in FIG. 20. Details of the slope filter process are described below. The outputs of the Slope Filter processing element 2002 are a slope sequence, m(n) and a standard deviation sequence, STD(n). These sequences, along with the FIFO status state variable FS(n) above, form inputs to a Steady State Logic processing element 2004, which generates the state variable SS(n), which takes on enumerated values in the set {FALSE, TRUE}, with TRUE indicating that the computed expected power should be representative of compressor power and FALSE indicating that it is not. Details of this logic are described below.

Figure 21:
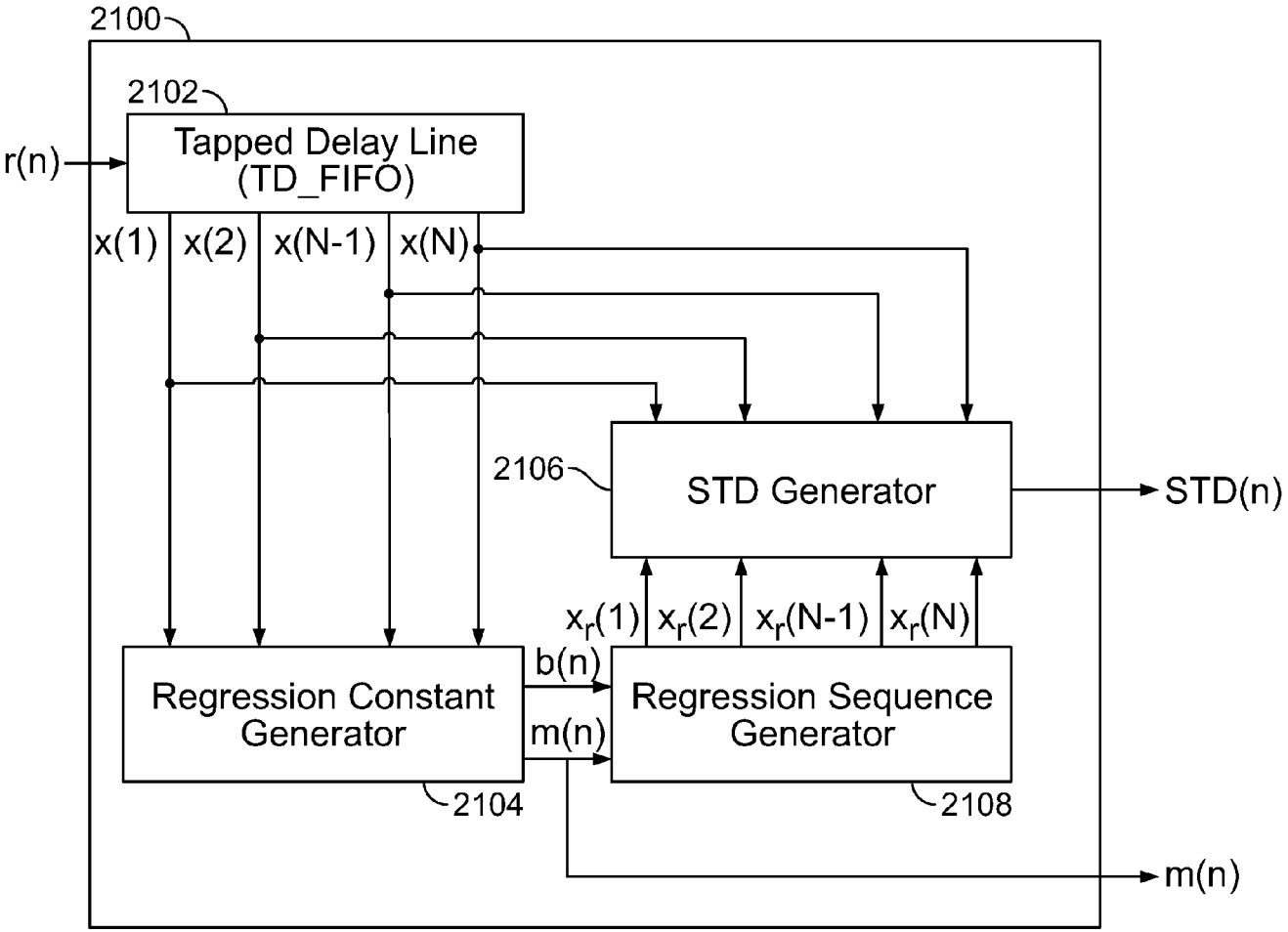
FIG. 21 is a block diagram of a slope filter function.

FIG. 21 is a block diagram of slope filter algorithm 2100. The slope filter algorithm 2100 observes a moving window of normalized residuals of the data, or the sequence r(n) defined above. Values of the normalized residual r(n) given by Equation (7) are presented on each elementary sampling cycle to TD_FIFO 2102 for storage, with the outputs of TD_FIFO the values of the moving window of stored states described above.

Once the TD_FIFO is declared "full" of data from the present HPAS by virtue of the FIFO state variable FS(n) set to TRUE, the slope filter algorithm 2100 fits an affine relation of the form:

$$x_r(k)=m(n)\times k+b(n), k=1, \ldots, N \tag{17}$$

where k is an index indicating the actual position of the data in the TD_FIFO, m(n) is the computed slope of the affine relation for this elementary process cycle and b(n) is the corresponding y-intercept. Computation of m(n) and b(n) is performed in a Regression Constant Generator 2104 functional block, the outputs of which are the slope sequence m(n) and y-intercept sequence b(n). The slope, m(n), is one of the outputs of the slope filter function 2100.

The computed values m(n) and b(n) for this elementary cycle feed the Regression Sequence Generator 2108, which computes the N values of the regression sequence $x_r(k)$, k=1, . . . , N. as outputs, with each $x_r(k)$ given by Equation (17). This finite sequence, along with the finite sequence x(k) from TD_FIFO 2102 serve as inputs to a functional block Standard Deviation (STD) Generator 2106, which computes the standard deviation of the difference or deviation between the finite sequence x(k) from TD_FIFO 2102 and the regression sequence $x_r(k)$ generated by regression sequence generator 2108. The output of the STD Generator 2106 is this standard deviation, STD(n), which is the second output of slope filter 2100.

Referring to Regression Constant Generator 2104, the method of slope and y-intercept of determination of the parameters m and b can be derived using any conventional regression analysis technique. For instance, the slope m(n) and y-intercept, b(n) can be computed on each elementary processing cycle using the following formulae:

$$m(n) = \frac{N\left(\sum_{k=1}^{N} kx(k)\right) - \left(\sum_{k=1}^{N} k\right)\left(\sum_{k=1}^{N} x(k)\right)}{N\left(\sum_{k=1}^{N} k^2\right) - \left(\sum_{k=1}^{N} k\right)^2}, \tag{18}$$

and $$b(n) = \frac{\left(\sum_{k=1}^{N} k^2\right)\left(\sum_{k=1}^{N} x(k)\right) - \left(\sum_{k=1}^{N} k\right)\left(\sum_{k=1}^{N} kx(k)\right)}{N\left(\sum_{k=1}^{N} k^2\right) - \left(\sum_{k=1}^{N} k\right)^2} \tag{19}$$

Next, the internal signal processing performed by the STD Generator 2106 is discussed. Define the kth deviation d(k), between the stored residuals in TD_FIFO and represented by the x(k) and the regression sequence $x_r(k)$ given by affine Equation (17) and computed by the Regression Sequence Generator 2108 by:

$$d(k)=x(k)-x_r(k), k=1, \ldots, N \tag{20}$$

In other words, d(k) is the difference or deviation of the kth residual stored in the FIFO from the value of the affine Equation (17) evaluated at k. Define in the usual way, the mean and variance of the resulting distribution d(k) by:

$$\bar{d} = \frac{1}{N}\sum_{k=1}^{N} d(k), \tag{21}$$

and $$\sigma_d^2 = \frac{1}{N}\sum_{k=1}^{N} (d(k) - \bar{d}(k))^2, \tag{22}$$

and the standard deviation STD(n) by the square root of the variance:

$$\mathrm{STD}(n)=\sqrt{\sigma_d^2} \tag{23}$$

Figure 22:
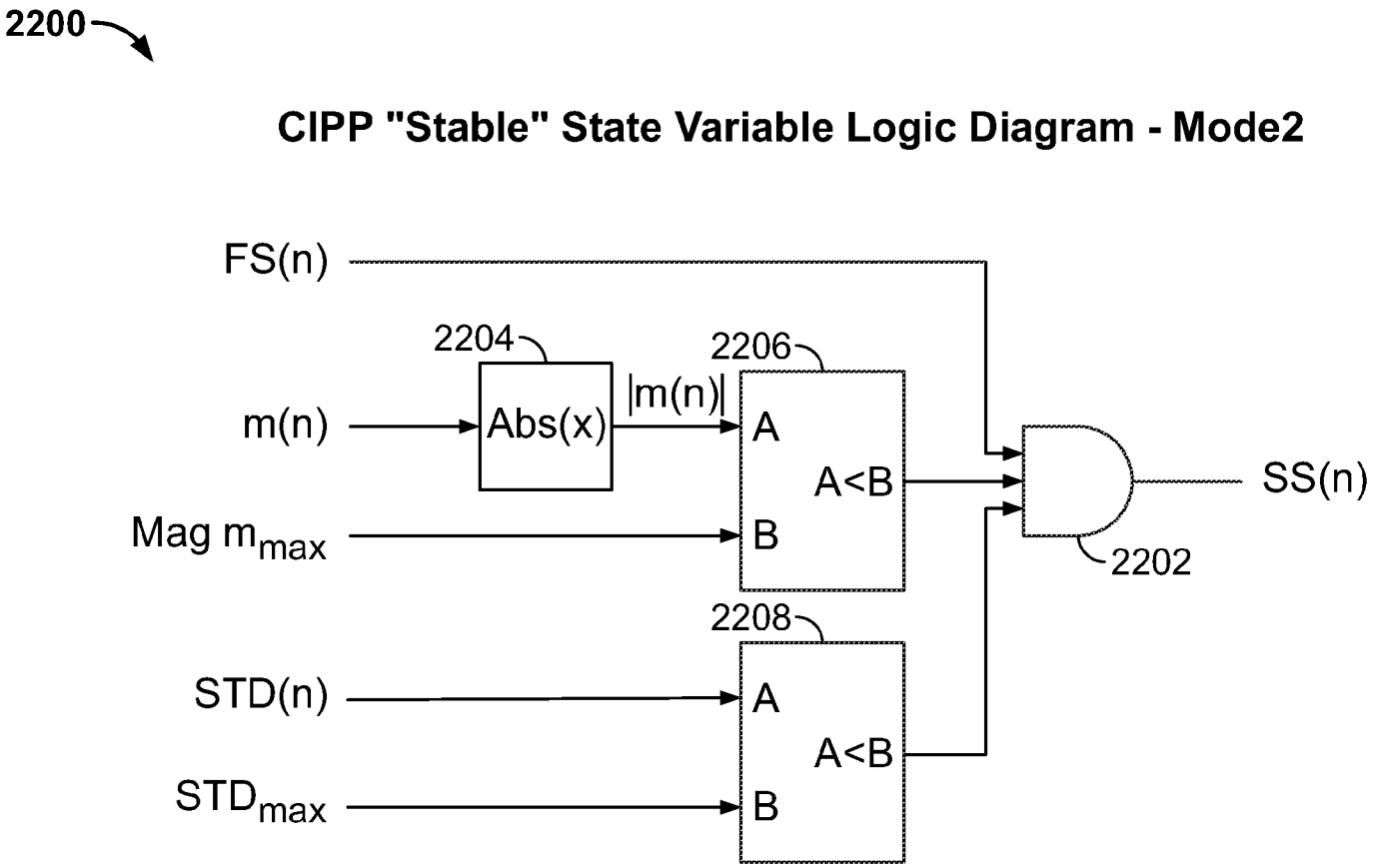
FIG. 22 is a graphical depiction of the logic performed on each elementary processing cycle to generate the present value of the sequence SS(n)

FIG. 22 is an graphical depiction of the Steady-State Detect Logic 2200 performed on each elementary processing cycle to generate the present value of the sequence SS(n). FS(n), m(n) and STD(n), discussed previously, and two parametric values, $\mathrm{Magm}_{max}$ and $\mathrm{STD}_{max}$, form the inputs to this logic. The values of $\mathrm{Magm}_{max}$ and $\mathrm{STD}_{max}$ are explicitly entered as commissioned machine constant values.

Referring to FIG. 22, the value of SS(n) is the logical conjunction of three values, represented by three-input logical AND gate 2202. First, it is clear that if TD_FIFO 2102 is not full of data from the present HPAS, it cannot be determined from m(n) and STD(n) whether the expected power $P_e(n)$ computed using the CIPP relation is a valid representation of compressor power because neither m(n) nor STD(n) are valid until TD_FIFO 2102 is full. Accordingly, one of the inputs to the logical conjunction 2202 is the present value of the sequence FS(n). If FS(n) is FALSE, the value of SS(n) is immediately set FALSE.

Assuming normal operation of the VCC-based heat pumping device, when the compressor 106 has been operating long enough for the refrigerant to be properly distributed and the estimated power $P_e$ representative of expected compressor power, the slope, m(n) computed for Equation (17) by the Regression Constant Generator 2104 will be zero, or nearly so. Mathematically, this condition indicates that the actual, measured compressor power is tracking the predicted power, deviating by a constant offset, perhaps zero in the case where it is tracking optimally. To account for this in the Steady State Detect Logic 2200, the absolute value of m(n) is computed in function block 2204, resulting in the absolute value of m(n), designated by |m(n)|, which is subsequently presented as the input A to a threshold detection block 2206. The threshold detection block 2206 is a two-input function, with inputs labeled A and B. The output of the threshold detection function block 2206 takes on the value TRUE, when the value of input A is less than that of input B, and FALSE otherwise. The input B of the threshold detection block 2206 is the value of the commissioned machine constant $\mathrm{Magm}_{max}$. The value of $\mathrm{Magm}_{max}$ is intended to be set very small, on the order of 0.05 or less, for example. When |m(n)| is less than $\mathrm{Magm}_{max}$, the output of the threshold detection block 2206 is TRUE, indicating that the condition that the slope of the regression of the residuals is sufficiently close to zero for the system 1100 to be considered stable. The output of threshold detection block 2206 forms the second input of the logical conjunction 2202.

When the slope m(n) in Equation (17), and computed by Equation (18) is zero, it should be apparent that, with the exception of random noise, each of the values x(k) from TD_FIFO 2102 should be approximately the value b(n) computed by the Regression Constant Generator 2104, and each resulting d(k) computed by Equation (20) should therefore be nearly zero. In this example, the standard deviation STD(n) is indicative of the "noisiness" of the residual r(n) values in the TD_FIFO 2102, and should be very small if the data acquisition equipment is operating properly. A third test for a stable system 1100 is to compare the present value of STD(n), which is by definition non-negative, against a small, positive threshold value, provided by the machine constant $\mathrm{STD}_{max}$. This comparison is made in a threshold detector 2208 in a manner identical to that described above with respect to the threshold detection function block 2206. If the present value of STD(n) is less than $\mathrm{STD}_{max}$, the residuals in TD_FIFO 2102 can be assumed to be generated by a system with normal data acquisition capability. The output of the threshold detector 2208 forms the third input of logical conjunction 2202. Typical practical values for $\mathrm{STD}_{max}$ have been determined experimentally to be on the order of 0.05, or 5%.

To summarize, satisfaction of these three conditions in combination implies that the CIPP relation is "tracking" the compressor power changes, differing by, at most, an offset, and that the data in the TD_FIFO of residuals 2102 is not just random noise, but is tracking a physical process, notably the vapor compression cycle itself.

Finally, the purpose and methodology of generating time-delayed versions of SS(n) and the sequences in Table 2 is discussed. As should be clear from the discussion of the algorithm used to generate COMP(n) above, when the compressor ON/OFF detection process declares a transition from the ON state to the OFF state in Mode1 or Mode2, the actual power to the compressor 106 has been observed below the threshold value $P_{th}$ for DBCref consecutive elementary processing cycles. This means that power must have been physically removed from the compressor/condenser unit 102 for at least a number of consecutive elementary processing cycles corresponding to DBCref. Because of the statistical nature of the steady-state detection process, at some point before the COMP(n) state variable is declared OFF, indicating the end of a heat pumping active cycle, SS(n) is likely to be declared UNSTABLE simply because power has been removed from the compressor/condenser unit 102, and not necessarily because the physical vapor compression equipment is behaving abnormally.

To compensate for this phenomenon, the sequence SS(n) is stored and delayed by $N_d$ samples in a delay line FIFO, where $N_d$ is a machine constant. Mathematically, the delayed sequence $SS_d(n)$ is related to SS(n) by:

$$SSd(n)=SS(n-N_d) \quad (24)$$

By choosing an appropriate value $N_d$ and using the delayed value, SSd(n) in subsequent calculations, the data at the end of the heat pumping active cycle can be ignored. An appropriate value of $N_d$ is a value larger than the debounce count. Because modern electrical switching devices can remove power from a system in significantly less time than a typical elementary processing period of 2 seconds, a value $N_d$ equal to DBCref+1 will suffice, and for a typical system, setting $N_d$ equal to two times DBCref has been demonstrated to work without an appreciable loss of accuracy. To synchronize the boxcar filtered values in Table 2 with SSd(n), each boxcar filtered value can also be delayed in a separate FIFO delay line by the same $N_d$ samples. This ensures that when comparisons are made to detect abnormalities, consistent sets of sequences are used, and that they represent data that was generated when the equipment was actually operating. An alternative to this approach is to simply store every boxcar filtered value in memory, resulting in large memory usage that is dependent upon the length of the heat pumping active subcycle. A fixed FIFO is a viable alternative in this case.

With the Background Task 1204 described per above, Table 3 summarizes the content of the data record produced by the Background Task module 1204 on each elementary process cycle.

TABLE 3

Background Task Data Record

| Element | Description | Units |
|---|---|---|
| $P_c$ | Measured Compressor Power | Watts |
| $T_c$ | Measured Compressor Inlet Temperature 302 | Deg C. |
| $T_r$ | Measured Return Duct Temperature 304 | Deg C. |
| $T_s$ | Measured Supply Duct Temperature 306 | Deg C. |
| $P_e$ | Estimated Compressor Power per Equation (1) | Watts |
| r | Normalized Residual Power per Equation (6) | None |
| COMP | Compressor State:<br>TRUE - Compressor On<br>FALSE - Compressor Off | T/F |
| SSd | CIPP Relation Stability - delayed:<br>TRUE - Relation meets stability criterion<br>FALSE - Relation does not meet stability criterion | T/F |
| FSd | TD_FIFO State<br>TRUE - TD_FIFOs have valid data<br>FALSE - TD_FIFOs do not have valid data | T/F |
| $P_{cfd}$ | Filtered measured compressor power - delayed | Watts |
| $P_{efd}$ | Filtered estimated compressor power - delayed | Watts |
| $T_{cfd}$ | Filtered compressor inlet temperature - delayed | Deg C. |
| $T_{sfd}$ | Filtered supply duct temperature - delayed | Deg C. |
| $T_{rfd}$ | Filtered return duct temperature - delayed | Deg C. |
| $r_{fd}$ | Filtered residual - Delayed | None |

1.5 HPAS State Machine Task

The HPAS state machine task manages the accumulation of data over a heat pumping active subcycle, maintaining two large data structures for use by other tasks to be described subsequently:

1. A structure of summary accumulators, herein named HPAS_ACC, for accumulating data regarding the entire heat pumping active subcycle.
2. A structure of steady state accumulators, herein named ON_ST_ACC, for accumulating data regarding the present STABLE sequence within the heat pumping active subcycle.

These two data structures are considered the outputs of the HPAS state machine task. Table 4 provides a definition of the summary accumulators stored by the HPAS task. These include the total number of elementary process cycles in the HPAS, as well as the total number of elementary process cycles in the STABLE (indicated by SSd(n)=TRUE) and NOT_STABLE (indicated by SSd(n)=FALSE) states. Also accumulated are the various boxcar filtered powers and measured temperatures, accumulated according to the value of SSd(n) for the particular cycle. By adding the STABLE and NOT_STABLE accumulated values, the total accumulated value for the HPAS can be computed.

TABLE 4

HPAS Summary Accumulator Structure

| Element | Stable Value Accumulated |
|---|---|
| HPAS_ACC.Cy | Total number of elementary process cycles since entering the HPAS_DataAcquisition state. |
| HPAS_ACC.Pc | Accumulation of the delayed, filtered measured power sequence, $P_{cd}(n)$ over the present HPAS. |
| HPAS_ACC.Tc | Accumulation of the delayed, filtered compressor inlet temperature $T_{cd}(n)$ over the present HPAS. |
| HPAS_ACC.Tr | Accumulation of the delayed, filtered return duct temperature $T_{rd}(n)$ over the present HPAS. |
| HPAS_ACC.Ts | Accumulation of the delayed, filtered supply duct temperature $T_{sd}(n)$ over the present HPAS. |
| HPAS_ACC.Pe | Accumulation of the delayed, filtered predicted power sequence, $P_{ed}(n)$ over the present HPAS. |
| HPAS_ACC.r | Accumulation of the delayed, filtered normalized residual accumulated over the present HPAS |

Another set of accumulators, named ON_ST_ACC is also maintained by the HPAS task, shown in Table 5. Each of these accumulators is updated by adding the corresponding filtered value to the present value of the accumulator when the value of SSd(n) is TRUE, indicating operation in the ON_ST region. Each ON_ST_ACC accumulator is cleared (set to zero) when the value of SSd(n) is FALSE, and COMP(n) is TRUE, indicating operation in the ON_NS region. Recall that the ON_ST region of the HPAS is measured from the end of the present HPAS backward to the first occurrence for which SSd(n) takes the value FALSE per the algorithm described above for SS(n). Multiple transitions of SSd(n) may be possible within an HPAS, with the result that a single HPAS may have multiple regions of ON_NS and ON_ST operation per FIG. 6. With the logic described above, at the end of the present HPAS, the ON_ST_ACC structure retains the data for the last ON_ST of the HPAS.

TABLE 5

Stable Accumulator Structure Contents

| Element | ON_ST Value Accumulated |
|---|---|
| ON_ST_ACC.Cy | Number of elementary process cycles for the ON_ST region of the present HPAS |
| ON_ST_ACC.Pc | Accumulation of delayed compressor power, $P_{cd}(n)$ for the ON_ST region of the present HPAS. |
| ON_ST_ACC.Pe | Accumulation of delayed predicted compressor power, $P_{ed}(n)$ for the ON_ST region of the present HPAS. |
| ON_ST_ACC.Tc | Accumulation of delayed compressor/condenser unit temperature sequence for the ON_ST region of the present HPAS |
| ON_ST_ACC.Ts | Accumulation of delayed supply temperature for the ON_ST region of the present HPAS. |
| ON_ST_ACC.Tr | Accumulation of delayed return temperature for the ON_ST region of the present HPAS. |

TABLE 5-continued

| Stable Accumulator Structure Contents | |
|---|---|
| Element | ON_ST Value Accumulated |
| ON_ST_ACC.r | Accumulation of residual rd(n) for the ON_ST region of the present HPAS. |

Figure 23:
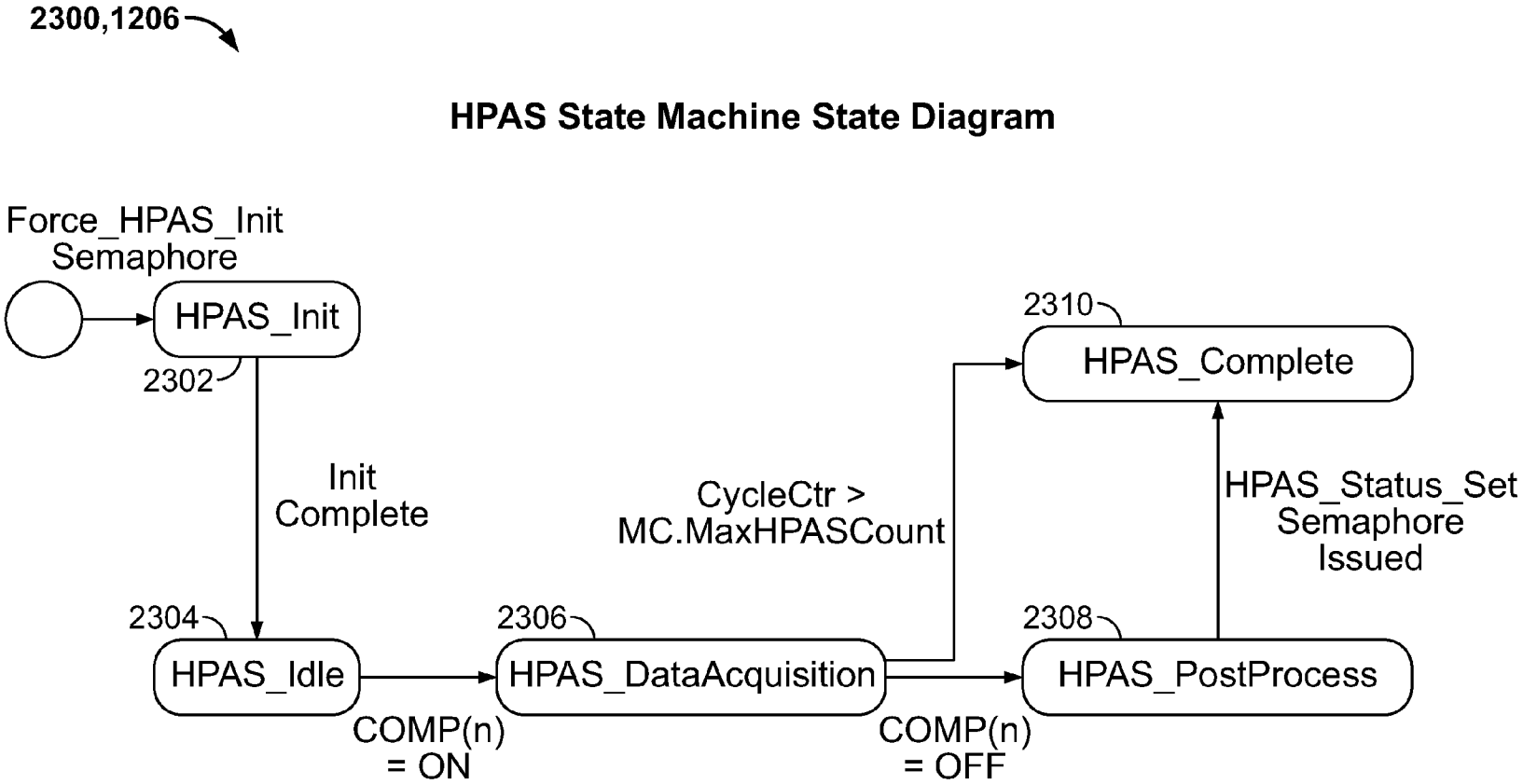
FIG. 23 illustrates a state diagram of the HPAS_Monitor task state machine.

FIG. 23 shows the state diagram of the HPAS_Monitor task 1206 (shown in FIG. 12), which is a state machine 2300. The state of the HPAS_Monitor task is visible to all other tasks in the system, via a globally available state variable HPAS_State, the value of which mirrors the present state of the HPAS_Monitor state machine task, taking on enumerated values in the set {HPAS_Init, HPAS_Idle, HPAS_DataAcquisition, HPAS_PostProcess, HPAS_Complete}. The meaning of each of these enumerated values and the corresponding state is described below in connection with the state machine.

A second variable, HPAS_ErrorCode, is maintained by the HPAS state machine 2300. This variable takes on values in the enumerated set {HPAS_Normal, HPAS_Timeout, HPAS_ShortCycle, HPAS_NotStable}. The meaning of these enumerated values is described below in connection with the state machine.

An external semaphore, Force_HPAS_Init, causes the HPAS state machine 2300 to immediately transition to state HPAS_Init 2302 shown in FIG. 23, regardless of the present state. The method by which this semaphore is generated will be discussed later. Upon entry to the HPAS_Init state 2302, the HPAS_State variable is assigned the value "HPAS_Init", the HPAS_ACC and ON_ST_ACC accumulator structures are initialized to zero, the Force_HPAS_Init semaphore is cleared, and the system transitions to the HPAS_Idle state 2304. In the HPAS_Idle state 2304, the HPAS task waits until the COMP(n) state variable is assigned the value TRUE (or ON) by the Background Task 1204, indicating the beginning of a new HPAS. The HPAS_State variable is assigned the enumerated value HPAS_Idle, indicating that the system is awaiting the start of an HPAS. In Mode0, this transition cannot occur, because the Background Task module 1204 always forces COMP(n)=FALSE (or OFF). In Mode1 or Mode2, COMP(n) may be set TRUE by the Background Task module 1204, at which time the HPAS state machine 2300 transitions to the HPAS_DataAcquisition state 2306, setting the HPAS_State variable to HPAS_DataAcquisition in the process.

In the HPAS_DataAcquisition state 2306, the HPAS state machine 2300 updates the accumulators structures HPAS_ACC and ON_ST_ACC on each elementary process cycle according to the descriptions above. The state machine 2300 remains in this state until the first of two events is satisfied. If the COMP(n) state variable has been assigned the value FALSE by the Background Task 1204, indicating the end of an HPAS, the HPAS state machine 2300 transitions to the HPAS_PostProcess state 2308, setting the HPAS_State variable in the process. If, before this transition can occur, the total number of accumulated cycles, stored in the accumulator HPAS_ACC.CyT exceeds the value of a machine constant MaxHPASCount, the HPAS is presumed to be taking too long, possibly indicating a problem with the system such as a stuck switch or a highly discharged compressor/condenser unit 102. In this case, the HPAS_ErrorCode is assigned the enumerated value HPAS_Timeout, indicating this condition and state machine 2300 transitions to the HPAS_Complete state 2310, setting the HPAS_State to HPAS_Complete in the process. The state machine 2300 remains in the HPAS_Complete state 2310 until a new Force_HPAS_Init semaphore is received.

Figure 24:
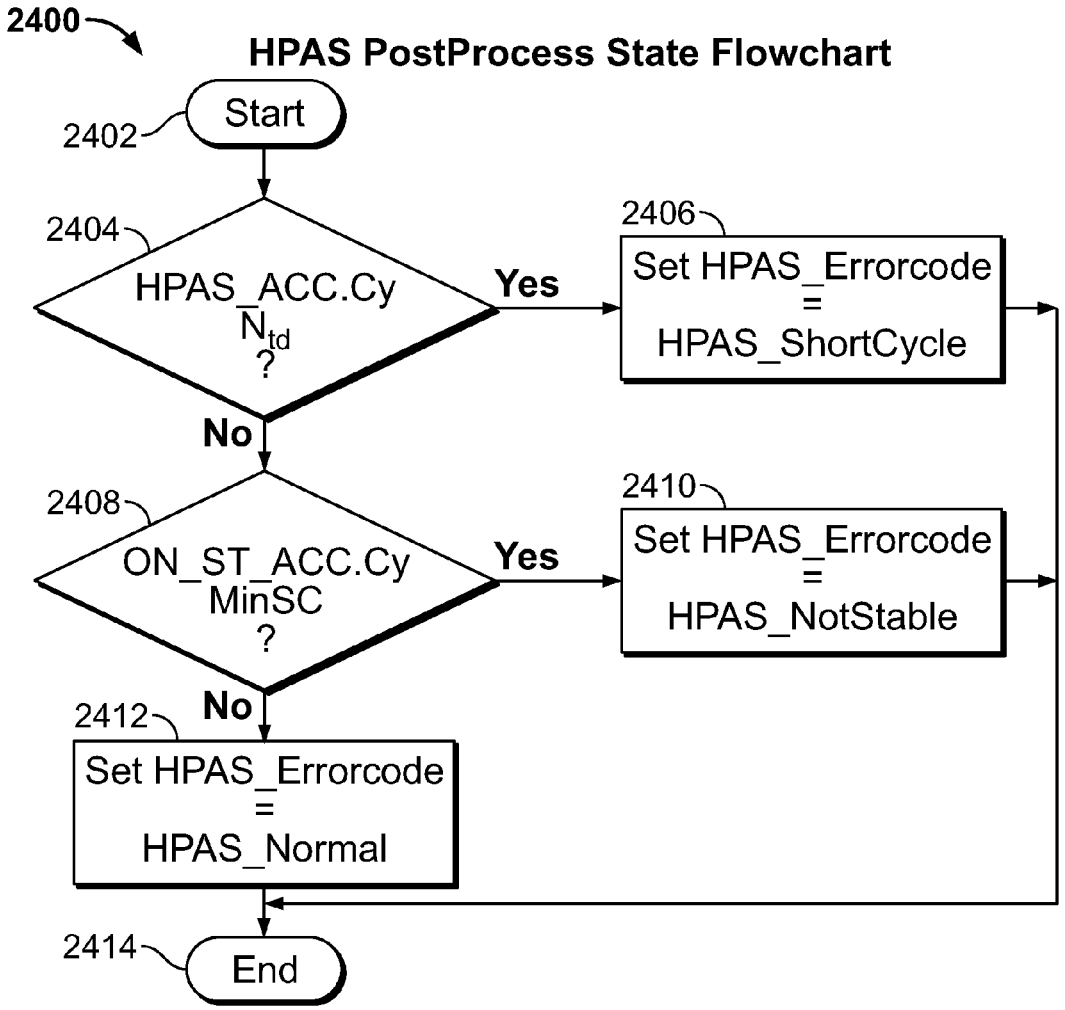
FIG. 24 is a flowchart of an HPAS post-process state for analyzing simple statistics obtained during the data acquisition process to set the HPAS_Status value.

In the HPAS_PostProcess state 2308, the task examines the conditions of the two accumulator structures to determine the value to assign to the HPAS_ErrorCode word before transition to the HPAS_Complete state 2310. FIG. 24 is a flowchart of a statistical analysis algorithm 2400 showing the processing performed in the HPAS_PostProcess state 2308. The purpose of this algorithm is to analyze the values accumulated while in the HPAS_DataAcquisition state and set the HPAS_ErrorCode value. Referring to FIG. 24, upon entry at 2402, the algorithm 2400 compares the total number of cycles in the HPAS, stored in the accumulator HPAS_ACC.Cy in Table 4, against the machine constant $N_{td}$, specifying the number of elements in the TD_FIFO memory arrangements (2404). If the total number of cycles is less than $N_{td}$, the routine sets the HPAS_ErrorCode to the value HPAS_ShortCycle in 2406, indicating the cycle was too short. The routine then exits at 2414.

If the number of cycles in the HPAS is greater than or equal to $N_{td}$ in 2404, control passes to a decision block 2408, where the number of consecutive cycles for which SSd(n) is set TRUE at the end of the HPAS, stored in accumulator ON_ST_ACC.Cy is compared against a minimum value provided by the machine constant MinSC. If ON_ST_ACC.Cy is less than MinSC, control passes to process block 2410, where HPAS_ErrorCode is assigned the enumerated value HPAS_NotStable, indicating that the accumulated values of estimated power while the system was last in the ON_ST state in the just completed HPAS should not be considered valid. This can be indicative of problems with the heat pumping equipment, most notably of the overcharging condition described previously. The algorithm 2400 then exits at 2414. Assuming the value in ON_ST_ACC.Cy is greater than or equal to the minimum number of cycles provided by the machine constant MinSC in decision block 2408, HPAS_ErrorCode is assigned the value HPAS_Normal in the process block 2412, indicating that a "normal" HPAS has been completed. Following this assignment the algorithm exits at 2414.

Referring back to FIG. 23, once a value of HPAS_ErrorCode has been assigned in the HPAS_PostProcess state 2308, the HPAS state machine 2300 transitions to HPAS_Complete state 2310. The HPAS state machine 2300 remains in this state until another HPAS_Force_Init semaphore is received from a task external to the HPAS task. This ensures that the data in the accumulators can remain intact until it is used, even in the event that another HPAS begins in the interim.

Recall from FIG. 2 that a heat pumping cycle, or HPC is defined to have two sub-cycles: a Heat Pumping Active Subcycle, or HPAS; or a Heat Pumping Inactive Subcycle, or HPIS.

Within the context of the present disclosure, these two subcycles can now be formally defined. An HPIS is defined by a period for which the COMP(n) variable is declared OFF according to the algorithm disclosed herein. An HPAS is defined as the period over which the COMP(n) variable is declared ON according to the algorithm taught herein. A heat pumping cycle is defined as the concatenation in time of a HPIS, followed by the corresponding HPAS. It is useful to assign index m, m=1, 2, . . . to each HPC, and the corresponding HPIS and HPAS.

Referring back to FIG. 6, a normal HPAS comprises an initial period in which the system is considered "NOT_STABLE" from the perspective of the relation between measured power and predicted power utilizing the CIPP relation, and a period over which the system is considered "STABLE"

with respect to the CIPP relation. Utilizing the delayed sequence SSd(n), one can now define an ON_ST region of FIG. 6 as a region of an HPAS for which SSd(n) is declared TRUE according to the logic above.

It should be clear from the definition above that the ON_ST accumulators of the HPAS task provide the statistical information regarding the last ON_ST region of the HPAS.

1.6 Alarm Logic Task Description

A building management system, such as the ANDOVER CONTINUUM™ system manufactured by Schneider Electric, is an example of a platform that can be configured to monitor compressor power and temperature, and can be programmed to implement the functions and methods described herein. Such systems are also capable of making logical comparisons between observed data and parametric limits, and have built-in functions to report anomalies in the form of alarms in many ways. In an implementation, the functions of CIPP processor 1102 can be performed by the Net Controller II processor of the ANDOVER CONTINUUM™ system. When CIPP Processor 1102 is implemented in such a system, the Net Controller II processor has access to the accumulator elements described above, as well as semaphores, state variables, and all variables generated by the Background Task module 1204, as they are internal values within the Net Controller II device.

Figure 25:
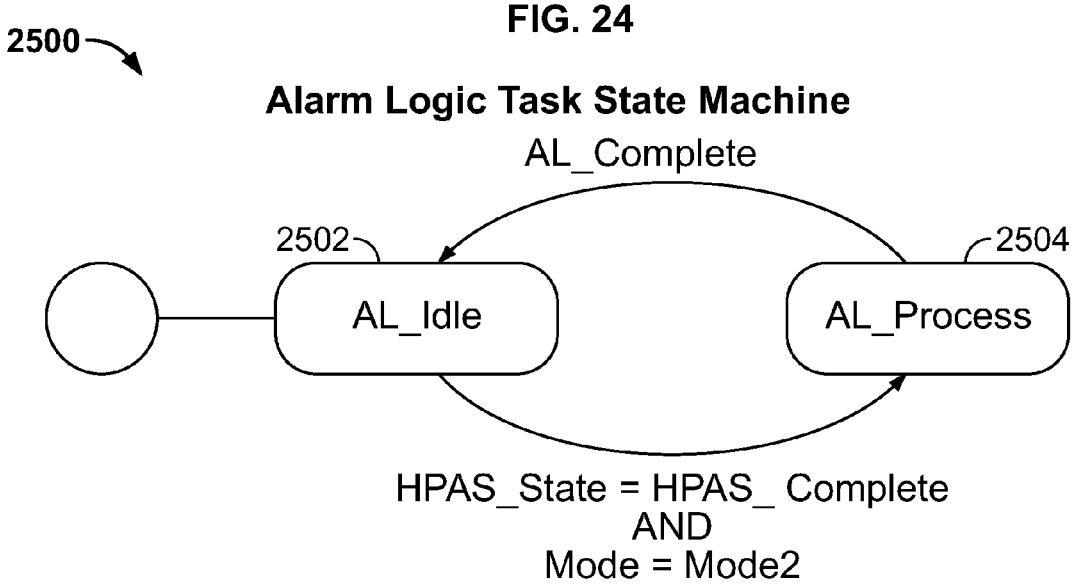
FIG. 25 is a state diagram of the Alarm Logic task.

The Alarm Logic task module 1212 analyzes the data produced by HPAS Monitor task module 1206 to generate appropriate alarms. FIG. 25 is an alarm logic task state diagram 2500 of the Alarm Logic Task module 1212, which comprises two states. The initial state of the Alarm Logic Task module 1212 is AL_Idle 2502, where it remains until it recognizes that CIPP Processor 1102 is operating in Mode2 and that the HPAS Monitor state machine 2300 has set the HPAS_State_to HPAS_Complete per above. At this point, alarm logic state machine 2500 transitions to AL_Process state 2504.

The records generated by the HPAS state machine 2300 and the Background Task module 1204 are available to the functions of AL_Process state 2504, which can examine the records and trigger alarms according to pre-programmed logic to be described subsequently. When this pre-programmed logic has been executed and any resulting alarms triggered, the logic issues the Force_HPAS_Init semaphore, and transitions back tothe AL_Idle state 2502.

As an example of logic that can be executed within AL_Process state 2504, suppose it would be desirable to generate an alarm indicating a possible low refrigerant level when the measured power becomes less than that predicted by some value. A 20% reduction in measured power over that expected has been experimentally determined to be a suitable value. In this example, the Net Controller II can be programmed to issue an alarm when the average residual over the last ON_ST region of an HPAS is less than a machine constant threshold value, $r_{rfth}$ specified by commissioning. Mathematically, the logical condition to be satisfied to generate such an alarm is:

$$-\frac{ACCS.r}{ACCS.CyS} > r_{rfth} \tag{25}$$

where $r_{rfth}$ is the positive threshold machine constant value programmed by commissioning, and wherein the negative sign indicates that when the measured compressor power is reduced by a loss of refrigerant, the residual is negative in accordance with Equation (6). Detection of such a condition can be programmed in the AL_Process task, which can trigger a "Low Refrigerant" alarm utilizing the facilities for displaying and communicating alarms already available in the ANDOVER CONTINUUM™ system. These facilities can include display of the alarm condition on a data entry panel, issuing an e-mail to a designated recipient indicating the nature of the alarm, and paging a specified person.

Another alarm that may be of interest is that indicating a failed compressor fan. This is indicated by a significant increase in the power consumed by the compressor/condenser unit 102 over predicted by the CIPP relation. Because of this severe increase in power, it has been observed that the system 1100 never enters the ON_ST before the system shuts down, either due to a thermal overload in the compressor motor, or an overpressure switch trip in the compressor/condenser unit 102. In this example, a second threshold, $r_{ffth}$, (for fan failure threshold) is defined, and the average threshold over the ON_NS portion of the cycle is compared to this threshold, which is much greater than 1.0, generating an alarm when the condition $$\frac{ACC.rN}{ACC.CyN} > r_{ffth} \tag{26}$$

is satisfied.

1.7 EPC Logging Task

In an example implemented in a building management system, an external monitoring system can gather information generated by the CIPP Processor 1102 and store it in a database for archival and other uses. In an implementation, the boxcar filtered sequences $P_{cf}(n)$, $T_{sf}(n)$, $T_{rf}(n)$ and $T_{cf}(n)$ are gathered by the external equipment and stored in a database where they can be examined by a user skilled in database management.

1.8 HPAS Logging Task

In Mode1 and Mode2, the structures generated by the HPAS state machine 2300 are uploaded by the external equipment, using receipt of the HPAS_State with the value HPAS_Complete, along with the corresponding HPAS_ErrorCode as the means to determine that new values of the accumulators are available. The values in the accumulators are useful in determining the CIPP coefficients in a manner described below, but can also be analyzed by external equipment to generate alarms and the like.

2 Description of the Learning Algorithms of the Present Disclosure

It is desirable to select appropriate values of the power threshold, $P_{th}$, which is the threshold by which CIPP processor 1102 used by the background process to declare the compressor/condenser unit 102 "ON" or "OFF" for each elementary process cycle. Similarly, to predict the compressor power using the hyperplane relation Equation (1) above, values for the machine constants $P_{c0}$, $k_c$, $k_r$ and $k_s$ are needed. The following describes how these parametric values can be determined according to an example.

2.1 Determining the Power Threshold Machine Constant $P_{th}$

In an example, the nominal line voltage and rated full-load current for the compressor/condenser unit 102 are generally provided on the compressor/condenser unit 102 nameplate. From these values a threshold value, $P_{th}$, can be derived according to a pre-determined rule, with $P_{th}$ a defined machine constant. For instance, in one commercially available, single-speed heat pump compressor/condenser unit designed to operate at a nominal 220 VAC, the rated full-load current drawn by the heat pump compressor/condenser unit is 13 Amperes. Given that the power consumed by the fan blowing ambient air over the condenser coil is typically significantly less than this power (measured to be approximately 200 Watts in the specific example), and that a residential heat pump compressor is power-factor compensated to achieve nominal unity power factor, arbitrarily setting a threshold at 25% of the rated power gives a threshold value of $$P_{th}=25\%\times 220\text{ Volts}\times 13\text{ Amperes}=715\text{ Watts}, \tag{27}$$

as a nominal threshold value that can be used as an indicator of whether the compressor is operating or not. The user or operator of the CIPP Processor 1102 can readily make this calculation and enter the value via commissioning.

2.2 Determining the CIPP Coefficients

Data can be acquired by external equipment from the CIPP Processor 1102 operating in Mode1 utilizing the HPC data logging capability of the system to determine the CIPP coefficients in a manual operation to be described now. It is assumed that the heat pumping equipment has been properly maintained and has been operating normally during a learning period, during which the equipment is operating in Mode1 or Mode2. A typical learning period in the summer in the southeast United States is about two to three weeks, for example, with a minimum of 100 heat pumping cycles detected.

Operating in Mode1, each time an HPAS completes, the accumulated values of $P_c$, $T_c$, $T_r$ and $T_s$ are provided via the ON_ST_ACC structure for the interval assumed to be representative of the ON_ST portion of the cycle, and defined by the commissioned value SSMode1_Delay as described above. External equipment, which receives the data, stores the structures in sequence, each time a new HPAS completes. For the training set, the first value of the ON_ST_ACC structure received by the system as ON_ST_ACC(1) is defined, the second is defined as ON_ST_ACC(2), etc., to where the mth such record received is denoted ON_ST_ACC(m).

Based on this information, average values for the mth HPAS structure, PcAvg(m), TsAvg(m), TrAvg(m) and TcAvg (m) can be created by:

$$PcAvg(m)=\frac{\text{ON_ST_ACC}.PcS}{\text{ON_ST_ACC}.CyT} \tag{28}$$

$$TcAvg(m)=\frac{\text{ON_ST_ACC}.TcS}{\text{ON_ST_ACC}.CyT} \tag{29}$$

$$TrAvg(m)=\frac{\text{ON_ST_ACC}.TrS}{\text{ON_ST_ACC}.CyT} \tag{30}$$

and $$TsAvg(m)=\frac{\text{ON_ST_ACC}.TsS}{\text{ON_ST_ACC}.CyT} \tag{31}$$

The methods of regression analysis and fitting experimentally gathered data to a specific model are well understood and there are numerous textbooks and references on this subject. The commercial mathematical analysis product MATLAB contains a curve fitting toolbox of computer programs that can readily perform this. A highly technical treatise of this subject can be found in "Optimization by Vector Space Methods," by David Luenberger, ISBN 471-55359x. Utilizing the commonly understood techniques of regression analysis, a least-squares fit of the sequences so derived can be performed to determine constants $k_c$, $k_r$, $k_s$ and $P_{c0}$ for Equation (1) such that the sum-squared error between PcAvg(m) and the estimated average power for the ensemble of training HPAS is minimized. The resulting values of $k_c$, $k_r$, $k_s$ and $P_{c0}$ are the desired CIPP coefficients.

It should be noted that the vapor compression system disclosed herein can include an air conditioner system, a heat pump system, a chiller, or a refrigeration system. The CIPP relation and other expected input power functions disclosed herein are suitable for use in any of such vapor compression systems, and the temperature measurements can be of a gas or a liquid.

Any of the algorithms disclosed herein include machine readable instructions for execution by: (a) a processor, (b) a controller, and/or (c) any other suitable processing device, such as the CIPP processor 1102. Any algorithm, function, relation, flowchart, or equation disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof can alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.). Further, although specific algorithms are described with reference to flowcharts or functional block diagrams depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the appended claims.

What is claimed is:

1. A method of automatically detecting an anomalous condition relative to a nominal operating condition in a vapor compression system, comprising:

automatically calculating a measured input power function that includes a current measured from a compressor unit of the vapor compression system, which includes a condenser unit coupled to the compressor unit;

receiving a condenser temperature indicative of an intake temperature from an intake of the condenser unit;

automatically calculating an expected input power function that includes the condenser temperature;

responsive to the expected input power function deviating from the measured input power function by more than a predetermined tolerance, storing an indication that an anomalous condition exists in the vapor compression system.

2. The method of claim 1, wherein the condenser temperature is the intake temperature.

3. The method of claim 2, wherein the intake temperature is received from a first temperature sensor positioned in an intake area of the condenser unit.

4. The method of claim 1, further comprising receiving an interior temperature indicative of an indoor temperature of an indoor environment or a temperature of a closed managed thermal space within the indoor environment, wherein the expected input power function includes the interior temperature.

5. The method of claim 4, wherein the interior temperature is a thermostat setpoint temperature.

6. The method of claim 4, wherein the interior temperature is an ambient temperature of an indoor environment on which the vapor compression system operates.

7. The method of claim 4, wherein the interior temperature is a return temperature from a temperature sensor positioned in an intake area of an evaporator unit in the vapor compression system, and wherein the expected input power function includes the return temperature.

8. The method of claim 7, wherein the expected input power function includes a power offset constant, a first condenser temperature coefficient, and a second interior temperature coefficient, the power offset constant being expressed in the unit of the measured input power function, the first condenser temperature coefficient representing temperature sensitivity relating to the condenser temperature, and the second interior temperature coefficient representing temperature sensitivity relating to the return temperature, the first condenser temperature coefficient being multiplied by the condenser temperature, the second interior temperature coefficient being multiplied by the return temperature.

9. The method of claim 8, further comprising receiving a supply temperature at a supply output of the evaporator unit, wherein the expected input power function further includes the supply temperature and a third interior temperature coefficient representing temperature sensitivity to the supply temperature, the third interior temperature coefficient being multiplied by the supply temperature.

10. The method of claim 9, further comprising automatically deriving the power offset constant, the first condenser temperature coefficient, the second interior temperature coefficient, and the third interior temperature coefficient by a least-squares regression analysis.

11. The method of claim 7, wherein the vapor compression system includes a heat pump system, and wherein refrigerant for the heat pump system is evaporated in the condenser unit, and wherein high-pressure refrigerant vapor is compressed in the evaporator unit.

12. The method of claim 4, wherein the interior temperature is a supply temperature from a supply output area of an evaporator unit in the vapor compression system, wherein the expected input power function includes the supply temperature.

13. The method of claim 4, wherein the interior temperature is a return temperature from an intake area of an evaporator unit, wherein the receiving the condenser temperature and the return temperature is carried out at a sample rate interval, the method further comprising:

delaying the automatically calculating the expected input power function by a predetermined number of cycles of a sample rate at which samples of the condenser temperature and the return temperature are received; and storing each sample of the condenser temperature and the return temperature.

14. The method of claim 4, wherein the condenser temperature is the intake temperature and wherein the intake temperature is received from a first temperature sensor positioned in an intake area of the condenser unit.

15. The method of claim 4, wherein the interior temperature is of a liquid or a gas.

16. The method of claim 4, further comprising:

automatically determining whether the compressor unit is in an ON state or an OFF state by comparing the measured input power function against a power threshold constant for a predetermined number of cycles as determined by a sampling rate of the current; and responsive to the measured input power function exceeding the power threshold constant for the predetermined number of cycles, storing an indication that the compressor unit is in the ON state wherein the current corresponds to a line current to the compressor unit that is measured by a current transformer, the measured input power function includes a line voltage measured across a line conductor and a neutral conductor connected to the compressor unit, and automatically calculating the measured input power function is carried out in a power monitor coupled to the current transformer; and wherein the expected input power function is calculated independent of any pressure measurement relating to the vapor compression system.

17. The method of claim 1, wherein the expected input power function is independent of any pressure measurement relating to the vapor compression system.

18. The method of claim 1, wherein responsive to the measured input power function being less than the expected input power function by more than the predetermined tolerance, the anomalous condition indicates a loss of refrigerant in the vapor compression system.

19. The method of claim 18, further comprising automatically calculating the expected input power function as refrigerant is added to the vapor compression system and, responsive to the expected input power function being within the predetermined tolerance of the measured input power function, indicating that the vapor compression system has returned to the nominal operating condition.

20. The method of claim 1, wherein responsive to the expected input power function being less than the measured input power function by more than the predetermined tolerance, the anomalous condition indicates a fouling of the condenser unit in the vapor compression system or a malfunctioning fan in the vapor compression system.

21. The method of claim 1, responsive to the measured input power function being less than the expected input power function by more than the predetermined tolerance, the anomalous condition representing a loss of refrigerant in the vapor compression system, the method further comprising:

automatically comparing the expected input power function with the measured input power function, in response to additional refrigerant being added to the vapor compression system, until the expected input power function falls within the predetermined tolerance of the measured input power function, and indicating to an operator that no additional refrigerant is required to be added.

22. The method of claim 1, wherein the current corresponds to a line current to the compressor unit measured by a current transformer, the measured input power function including a line voltage measured across a line conductor and a neutral conductor connected to the compressor unit, wherein the automatically calculating the measured input power function is carried out in a power monitor coupled to the current transformer.

23. The method of claim 1, wherein the vapor compression system includes an air conditioner system, a heat pump system, a chiller, or a refrigeration system.

24. The method of claim 1, further comprising:

automatically determining whether the compressor unit is in an ON state or an OFF state by comparing the measured input power function against a power threshold constant for a predetermined number of cycles as determined by a sampling rate of the current; and responsive to the measured input power function exceeding the power threshold constant for the predetermined number of cycles, storing an indication that the compressor unit is in the ON state.

25. The method of claim 24, further comprising deriving the power threshold constant by multiplying a nominal system voltage of the vapor compression system by a rated full-load current drawn by the compressor unit to produce a rated power, and multiplying the rated power by a percentage threshold.

26. The method of claim 25, further comprising, responsive to the measured input power function not exceeding the power threshold constant for a second predetermined number of cycles, storing an indication that the compressor unit is in an OFF state.

27. The method of claim 1, wherein the condenser temperature is of a gas or a liquid.

28. The method of claim 1, wherein the current measured from the compressor unit is an RMS current calculated from the measured current.

29. The method of claim 1, wherein the condenser temperature is an outdoor temperature of an outdoor environment.

* * * * *